US011891892B2

(12) United States Patent
Zheng et al.

(10) Patent No.: US 11,891,892 B2
(45) Date of Patent: Feb. 6, 2024

(54) SQUARE PILE CONSTRUCTION METHOD AND EQUIPMENT OF A ROTARY DRILLING RIG

(71) Applicant: Chengdu Xinhao Foundation Engineering Co., Ltd., Chengdu (CN)

(72) Inventors: Biao Zheng, Chengdu (CN); Jie Zheng, Chengdu (CN); Changwei Li, Chengdu (CN)

(73) Assignee: Chengdu Xinhao Foundation Engineering Co., Ltd., Chengdu (CN)

( * ) Notice: Subject to any disclaimer, the term of this patent is extended or adjusted under 35 U.S.C. 154(b) by 122 days.

(21) Appl. No.: 17/714,693

(22) Filed: Apr. 6, 2022

(65) Prior Publication Data

US 2022/0228440 A1 Jul. 21, 2022

Related U.S. Application Data

(63) Continuation of application No. PCT/CN2021/113784, filed on Aug. 20, 2021.

(30) Foreign Application Priority Data

Nov. 4, 2020 (CN) ..... 202011217145.9
Jan. 4, 2021 (CN) ..... 202110002338.0
(Continued)

(51) Int. Cl.
*E21B 7/00* (2006.01)
*E21B 4/00* (2006.01)
*E21B 4/16* (2006.01)

(52) U.S. Cl.
CPC ..... *E21B 7/001* (2013.01); *E21B 4/006* (2013.01); *E21B 4/16* (2013.01)

(58) Field of Classification Search
CPC . E21B 7/002; E21B 4/006; E02D 5/34; E02D 5/36; E02D 5/38
See application file for complete search history.

(56) References Cited

U.S. PATENT DOCUMENTS 2,950,902 A * 8/1960 Olds ..... E21B 7/005 175/323
5,026,216 A 6/1991 Koiwa

FOREIGN PATENT DOCUMENTS

AU 610372 B2 5/1991
CN 204753593 U 11/2015
(Continued)

OTHER PUBLICATIONS

International Search Report and Written Opinion; International Searching Authority/CN dated Nov. 19, 2021; International Application No. PCT/CN2021/113784; 8 pgs.; International Searching Authority/National Intellectual Property Administration, PRC; Beijing, China.
(Continued)

*Primary Examiner* — Robert E Fuller
(74) *Attorney, Agent, or Firm* — Andrew D. Fortney; Central California IP Group, P.C.

(57) ABSTRACT

A square pile construction method and equipment of a rotary drilling rig are disclosed. The square pile construction method includes: site leveling; surveying and setting out; creating concrete retaining wall of wellhead; putting the drilling rig in place; adjusting the verticality of the drilling rig; lead hole drilling; reamed hole drilling; square hole drilling; hole cleaning with round drill bit; and hole cleaning with square drill bit. The square pile construction method and rotary drilling rig can use equipment for square pile construction in the whole process. Three kinds of square pile drill bits and a square pile hole cleaning drill bit in cooperation with the square pile construction method, which
(Continued)

further realizes the mechanization of the whole process of square pile construction, are disclosed.

19 Claims, 27 Drawing Sheets

(30) Foreign Application Priority Data

| | | |
|---|---|---|
| Jan. 23, 2021 | (CN) | 202110091908.8 |
| Mar. 16, 2021 | (CN) | 202110280580.4 |
| Jul. 7, 2021 | (CN) | 202110767464.5 |

(56) References Cited

FOREIGN PATENT DOCUMENTS

| | | | |
|---|---|---|---|
| CN | 105113986 | A | 12/2015 |
| CN | 105887814 | A | 8/2016 |
| CN | 107587840 | A | 1/2018 |
| CN | 107803942 | A | 3/2018 |
| CN | 109681116 | A | 4/2019 |
| CN | 209129534 | U | 7/2019 |
| CN | 110820729 | A | 2/2020 |
| DE | 68925740 | T2 | 7/1996 |
| JP | 2000008372 | A | 1/2000 |
| JP | 2018062806 | A | 4/2018 |

OTHER PUBLICATIONS

Chen Yongliang et al.; "Research on Construction Characteristics and Quality Assurance Measures of Rotary Excavator with Square Chisel to Excavate Square Pile"; Road Engineering, No. 4, 2020; China Academic Journal Electronic Publishing House; http://www.cnki.net.

* cited by examiner

SQUARE PILE CONSTRUCTION METHOD AND EQUIPMENT OF A ROTARY DRILLING RIG

TECHNICAL FIELD

The present invention belongs to the technical field of engineering construction, and particularly relates to a square pile construction method and equipment of a rotary drilling rig.

BACKGROUND

With the continuous development of social economy in our country, the investment in national infrastructure construction is now more inclined to the central and western regions, especially the mountainous and dangerous areas such as Yunnan-Guizhou Plateau, Panxi Plateau and Qinghai-Tibet Plateau. National infrastructure projects to be built or being built such as multiple expressways (e.g., Sichuan Riverside Expressway, Lexi Expressway, etc.) or high-speed railways (e.g., Sichuan-Tibet railway, etc.) are located in many earthquake zones with high mountains and precipitous paths, which are very likely to suffer from geological disasters such as mountain collapse and debris flow. Thus, requirements for border support of these infrastructure projects are relatively high, and more design elements of square supporting slide-resistant piles are added to the construction drawing design.

The designed aperture of square supporting piles is relatively large. At present, most of the piles are made by manual hole digging, and few are made by mechanical drilling. Due to the limitation of related machines and technologies, the construction quality and efficiency are generally unsatisfactory.

Meanwhile, manual hole digging has at least the following disadvantages: 1. high risk factor and high cost of safety protection; 2. large loss of retaining wall materials; 3. extremely low construction efficiency and high work efficiency cost; 4. excessively high comprehensive cost of manual hole digging construction (including cost of manual hole digging, cost of electricity, cost of retaining wall material, cost of retaining wall template, cost of safety measures, work efficiency cost caused by low labor efficiency, etc.).

SUMMARY

An objective of the present invention is to provide a square pile construction method and equipment of a rotary drilling rig.

In order to achieve the above objective of the present invention, a technical solution adopted by the present invention is to provide a square pile construction method of a rotary drilling rig, which comprises the following steps:

S1: site leveling; S2: surveying and setting out; S3: creating concrete retaining wall of wellhead; S4: putting the drilling rig in place; S5: adjusting the verticality of the drilling rig; S6: lead hole drilling: setting lead holes in the retaining wall, and performing drilling based on the lead holes to form square pile drilled holes; S7: reamed hole drilling: continuing to drill reamed holes on the basis of lead hole drilling, and forming preformed holes after lead hole drilling and reamed hole drilling; S8: square hole drilling: performing square hole drilling after preformed holes are formed by the lead hole drilling and reamed hole drilling of the drilling rig described above; S9: hole cleaning with round drill bit: after the step S8, cleaning sediment at the bottom of the hole, and repeatedly sweeping the bottom of the hole from one end to the other end until the sediment at the bottom of the hole is basically cleaned up; S10: hole cleaning with square drill bit: continuing to clean the sediment at the bottom of the hole with a square drill bit for hole cleaning.

Preferably, after the step S10, the method further comprises the following steps:

S11: measuring the sediment; S12: fabricating and installing a reinforcing cage; and S13: pouring concrete.

Preferably, the step S6 of lead hole drilling comprises the following two drilling methods according to different geological structures:

(1) four-corner lead hole drilling method: for pile foundation with stable stratum structure, opening plum-blossom-shaped lead holes at four corners of the pile foundation with a round pick bailing drill bit, each lead hole being drilled to the designed hole bottom elevation;

(2) single lead hole drilling method: for pile foundation with unstable stratum structure, drilling a lead hole in the pile foundation in the distal direction deviated from the drilling rig with a round pick bailing drill or drill bit until the designed hole bottom elevation, the size of the round pick bailing drill or drill bit being larger than that of the round pick bailing drill bit in the method (1).

Preferably, the step S7 of reamed hole drilling comprises following two hole-forming methods according to different geological structures:

(1) four-corner lead hole drilling method: for pile foundation with stable stratum structure, drilling in the center of a square pile with a round pick bailing drill until the designed pile bottom elevation and forming a preformed hole;

(2) single lead hole drilling method: for pile foundation with unstable stratum structure, drilling the square pile at the proximate end that is near the rotary drilling rig with a round pick bailing drill until the designed pile bottom elevation and forming a preformed hole, the size of the round pick bailing drill or drill bit being smaller than that of the round pick bailing drill bit in the method (1).

Preferably, the step S8 of square hole drilling is carried out by a square pile drill bit which comprises a box body, which is configured with a power driving device, a power transmission mechanism and an actuator; the power driving device comprises a power transmission shaft, a first connecting square head, a lifting pressure plate and a pressure conducting plate; the middle of the box body is configured with two power transmission shafts which are rotatably connected with the box body, and respectively located at upper and lower sides of the box body; the upper and lower sides of the shaft are respectively provided with a first bearing pressure plate and a second bearing pressure plate, which are connected with the box body by screws; the shaft is between the first bearing pressure plate and the second bearing pressure plate; the upper end of the box body is connected with a lifting pressure plate by screws; the upper outer wall of the power transmission shaft is provided with a shoulder which is in the lifting pressure plate; the lower side of the shoulder is configured with a pressure conducting plate which is fixedly connected to the upper side of the box body, and the upper side of the power transmission shaft is fixedly connected with the power input first connecting square head.

Preferably, the power driving device is connected with the power transmission mechanism; the power transmission mechanism comprises first driving sprockets, second driving sprockets, power input sprockets, first chains, reversing transmission boxes, transmission shafts, first sprockets, second sprockets and second chains; the middle of the power transmission shaft is connected with the first driving sprocket and the second driving sprocket; the first driving sprocket is located on the upper side of the second driving sprocket; both the left and right sides of the inner cavity of the box body are connected with the reversing transmission box; the upper end of the input shaft of the reversing transmission box is connected with the power input sprocket; the first chain is installed respectively between the power input sprocket on the left side and the first driving sprocket, and between the power input sprocket on the right side and the second driving sprocket; both the front and rear sides of the reversing transmission box are configured with an output shaft, and the output shaft of the reversing transmission box is connected with the transmission shaft via a shaft coupler.

Preferably, the power transmission mechanism is connected with an actuator, and the actuator comprises first actuating components and second actuating components; both the left and right sides at the lower part of the box body are configured with a first actuating component, which is in transmission connection with the transmission shaft through the first sprocket, the second sprocket and the second chain, and ends of the transmission shaft away from the box body are all configured with a second actuating component.

Preferably, the first actuating component comprises a rotary shaft and a first digging actuating element; the rotary shaft is rotatably connected with the box body; the outer wall of the rotary shaft is fixedly connected with the first digging actuating element; both the front and rear ends of the rotary shaft are configured with the second sprocket; the transmission shaft is connected with the first sprocket; the position of the first sprocket and the position of the second sprocket are in left-and-right correspondence, and the second chain is installed between the first sprocket and the second sprocket.

Preferably, the second actuating component comprises a crawler-type driving wheel, a crawler-type driven wheel, a crawler chain rail, a second digging actuating element, a power plate and a driven shaft; the crawler-type driving wheel is connected with one end of the transmission shaft away from the box body; both left and right sides at the lower part of the box body are rotatably connected with the driven shaft; both the front and rear ends of the driven shaft are connected with the crawler-type driven wheel; the position of the crawler-type driving wheel and the position of the crawler-type driven wheel are in left-and-right correspondence; the crawler chain rail is installed between the crawler-type driving wheel and the crawler-type driven wheel; the outer wall of the crawler chain rail is fixedly connected with the power plate, and both front and rear sides of the power plate are connected with the second digging actuating element.

Preferably, the lower side of the box body is connected with a lifting protection shaft, and the lifting protection shaft is located at the lower side of the first power transmission shaft.

Preferably, the step S8 of square hole drilling is carried out by a square pile drill bit, the square pile drill bit comprises a power head component, a power transmission component and third actuating components; the power head component comprises a frame, a second connecting square head, a second power transmission shaft and slewing bearings; both the upper and lower sides at the middle part of the frame are installed with the slewing bearing; the frame is rotatably connected with the second power transmission shaft through the slewing bearing; the upper end of the second power transmission shaft is fixedly connected with the second connecting square head, and the outer edge of the frame is uniformly installed with the third actuating components.

Preferably, the actuating component comprises transmission shafts, shaft sleeves and cutting actuating elements; the shaft sleeve is connected to the outer edge of the frame, and the inside of the shaft sleeve is rotatably connected with the transmission shaft through the bearing.

Preferably, the cutting actuating element comprises first cutting actuating elements and second cutting actuating elements, which are respectively fixedly connected to lower ends of two adjacent transmission shafts, and the first cutting actuating element and the second cutting actuating element are distributed in a staggered manner.

Preferably, the power transmission component is between the third actuating component and the power head component, comprising driving sprockets, first driven sprockets, second driven sprockets, first transmission chains and second transmission chains; the upper end of the second power transmission shaft is installed with two driving sprockets; the positions of the two driving sprockets are in up-and-down correspondence; the upper end of the transmission shaft on the left side is connected with the first driven sprocket; the upper end of the transmission shaft on the right side is connected with the second driven sprocket; the first transmission chain is between the driving sprocket on the upper side and the first driven sprocket, and the second transmission chain is ; between the driving sprocket on the lower side and the second driven sprocket.

Preferably, the second power transmission shaft is a stepped shaft, and the stepped part of the second power transmission shaft is at the lower side of the frame.

Preferably, the driving sprocket is matched with both the first driven sprocket and the second driven sprocket, and the first driven sprocket is the same as the second driven sprocket, and the outer diameter length of the driving sprocket is larger than the outer diameter lengths of the first driven sprocket and the second driven sprocket.

Preferably, the slewing bearing is a slewing bearing without external teeth.

Preferably, the step S8 of square hole drilling is carried out by a square pile drill bit, which comprises a box body; the edges inside the box body are longitudinally configured with evenly arranged grinding shaft sleeves; the lower ends of the evenly arranged grinding shaft sleeves all penetrate the lower sidewall of the box body and extend to the lower end of the box body, configured with grinding heads; the upper ends of the grinding shaft sleeves all penetrate the upper sidewall of the box body and extend to the upper end of the box body, configured with hydraulic motors; the sidewall of the hydraulic motor is configured with an oil outlet; the upper end of the oil outlet is provided with an oil inlet; oil tanks are fixedly arranged inside the box body; the number of the oil tanks is at least two, and a motor and a hydraulic pump are between the respective oil tanks.

Preferably, the motor comprises a first motor, the output end of the first motor is configured with a first hydraulic pump; the sidewall of the first hydraulic pump is configured with a first inlet and a first outlet; the right end of the first motor is configured with a second motor; the output end of the second motor is configured with a second hydraulic pump, and the sidewall of the second hydraulic pump is configured with a second inlet and a second outlet.

Preferably, the upper sidewall of the box body is configured with an anti-rotation plate; a third connecting square head is longitudinally arranged inside the anti-rotation plate; the lower sidewall of the third connecting square head is connected with the upper sidewall of the box body; the sidewall of the third connecting square head is configured with symmetrical square head reinforcing plates, and one side of the square head reinforcing plate away from the third connecting square head is connected with the inner wall of the anti-rotation plate.

Preferably, a grinding head transmission shaft is longitudinally arranged inside the grinding shaft sleeve; the lower end of the grinding head transmission shaft is connected with the grinding head; the upper end of the grinding head transmission shaft penetrates the upper sidewall of the grinding shaft sleeve and is connected with the output end of the hydraulic motor, and the upper end of the wall of the grinding head transmission shaft is rotatably connected with the grinding shaft sleeve.

Preferably, the grinding head comprises a cutter body and convex components, and the convex components are uniformly arranged around the cutter body.

Preferably, the oil outlet of the hydraulic motor is connected with the oil tank; the first inlet of the first hydraulic pump and the second inlet of the second hydraulic pump are both connected with the oil tank, and the first outlet of the first hydraulic pump and the second outlet of the second hydraulic pump are both connected with the hydraulic motor.

Preferably, the square drill bit for hole cleaning in step S10 is a square pile hole cleaning drill and comprises a power input fourth connecting square head and a mounting frame plate; the bottom of the power input fourth connecting square head is connected with a mounting plate; the bottom of the mounting plate is connected with an outer ring of a slewing bearing with external teeth; an inner ring of the slewing bearing with external teeth is connected to the middle of the top of the mounting frame plate; both left and right sides at the top inside the mounting frame plate are longitudinally configured with movable grooves, an inner wall of the movable groove is configured with a bearing; an inner wall of the bearing is connected with an outer wall of a connecting post; a top of the connecting post is connected with a transmission gear; an outer ring of the slewing bearing with external teeth is engaged with the transmission gear; a bottom of the connecting posts on left and right sides is respectively connected with a first winding drum and a second winding drum; the middle part inside the mounting frame plate is longitudinally configured with a sliding post, a top and bottom of a front face of the sliding post are respectively configured with a first connecting shaft and a fifth connecting shaft; the outer wall of the sliding post is sleeved with a stretching connecting sleeve; the upper part, middle part and lower part of the front face of the stretching connecting sleeve are respectively configured with a second connecting shaft, a third connecting shaft and a fourth connecting shaft; a first winding drum and a second winding drum are respectively wound thereon with one end of a first wire rope and a second wire rope; the other end of the first wire rope is converted and connected with a knot to the second connecting shaft through the first connecting shaft; the other end of the second wire rope is converted and connected with a knot to the fourth connecting shaft through the fifth connecting shaft; both the left and right sides at the top of the mounting frame plate are hinged with a soil clamping plate; the third connecting shaft is connected with one end of the transmission shaft through a pin shaft, and the other end of the transmission shaft is hinged with the soil clamping plate.

The present invention has the following benefits: the present invention provides a new square pile construction method of a rotary drilling rig, which can use equipment for square pile construction in the whole process, effectively reduce the underground operation of laborers, and avoid the project safety production risk from the source. The present invention also provides three kinds of square pile drill bits and a square pile hole cleaning drill in cooperation with the square pile construction method, which further realizes the mechanization of the whole process of square pile construction.

DETAILED DESCRIPTION

The technical solution of the present invention will be clearly and completely described below with reference to drawings in the present invention. Obviously, the embodiments described are only a part but not all of the embodiments of the present invention. Unless particularly specified, the technical means used in the embodiments are conventional means well known to those skilled in the art.

In the description of the present invention, it shall be appreciated that, orientations or positional relationships indicated by terms of "longitudinal", "lateral", "up", "down", "front", "rear", "left", "right", "vertical", "horizontal", "top", "bottom", "inside" and "outside" are orientations or positional relationships shown based on the drawings, and they are only used for convenience of describing the present invention, and are not intended to indicate or imply that the device or element indicated must have a specific orientation, be constructed and operated in a specific orientation. Thus, these terms cannot be understood as limitation of the present invention.

Figure 1:
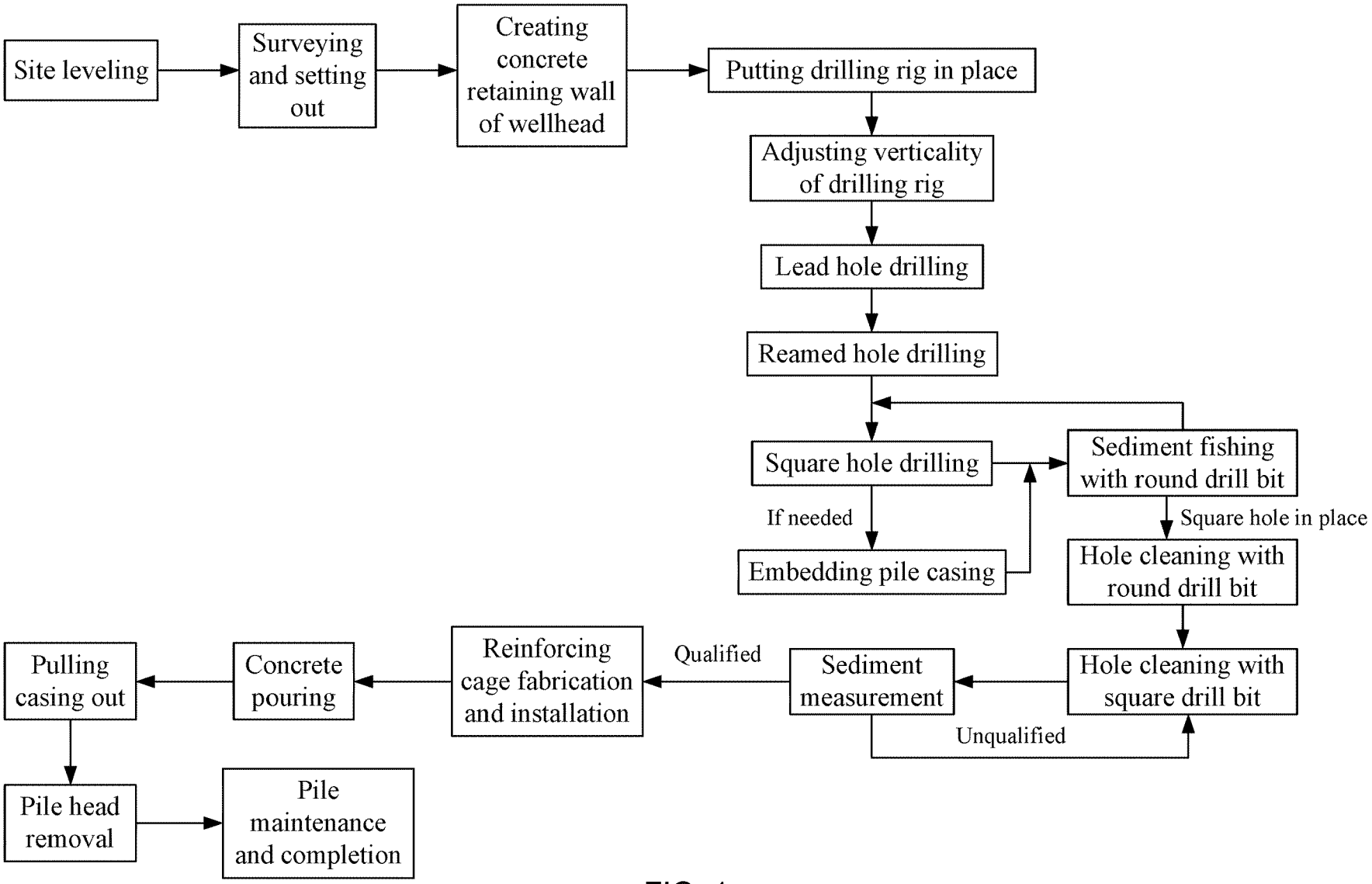
FIG. 1 is a schematic flowchart diagram of a square pile construction method of a rotary drilling rig of the present invention.
Figure 2:
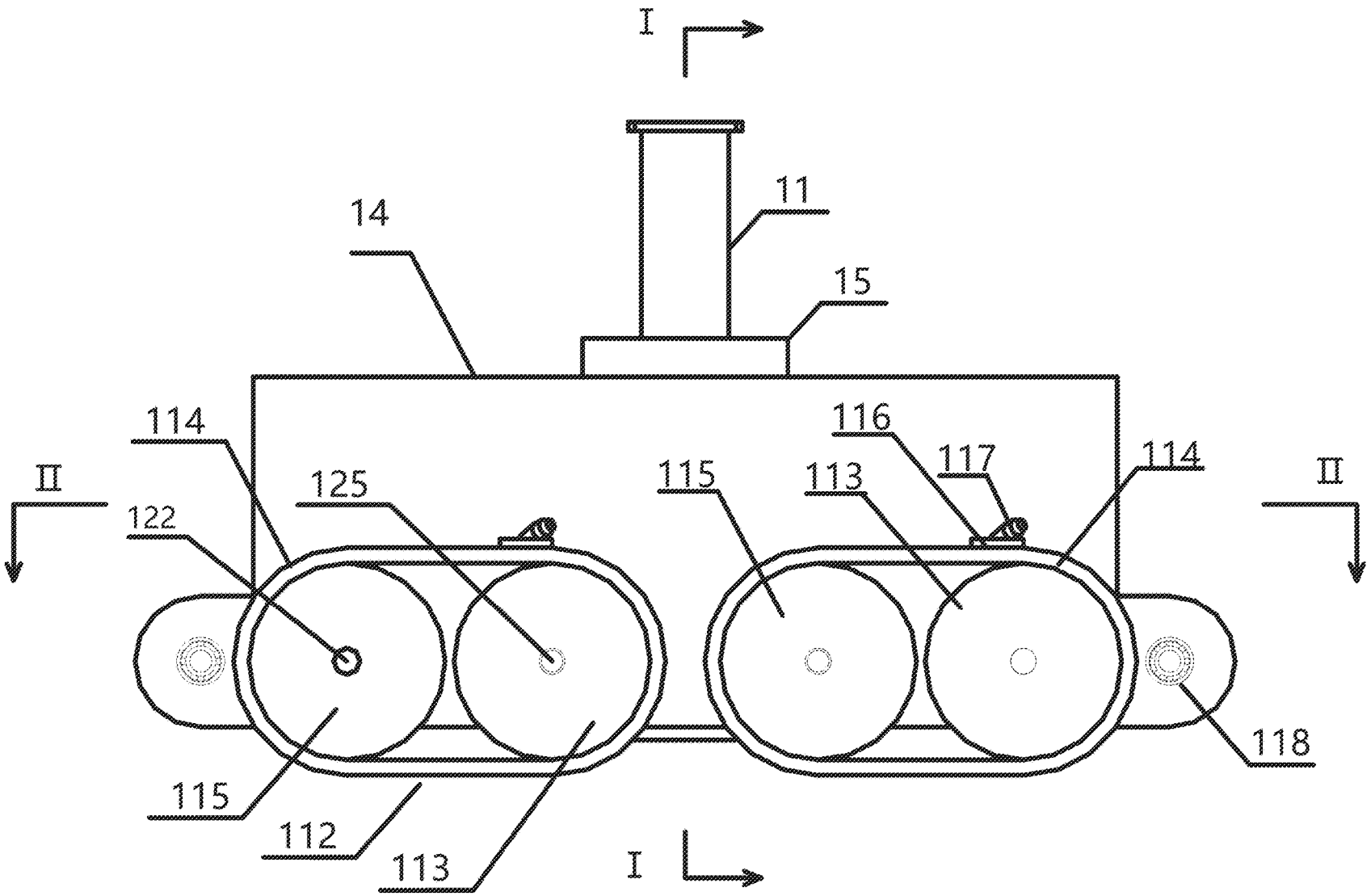
FIG. 2 is a schematic structural view of a square pile drill bit according to one embodiment of the present invention.

A first objective of the present invention is to provide a square pile construction method of a rotary drilling rig. The construction machineries, processes, drilling tools adopted or the like vary depending on different geological structures and different design specifications of square slide-resistant piles. All embodiments of the present invention take square piles with a design specification of (2.0 m×3.0 m) as examples. As shown in FIG. 1, the construction method specifically comprises the following steps:

S1: site leveling: performing land leveling and compaction on land at the construction site in advance;

S2:surveying and setting-out: measuring data and setting out on the leveled site, and marking out a position where drilling and construction are required;

S3: creating concrete retaining wall of wellhead: pouring concrete to form the retaining wall at the position where drilling and construction are required;

S4: putting the drilling rig in place: moving the drilling rig to the retaining wall, and before putting the drilling rig in place, the ground is compacted to ensure the stability of the drilling rig, thereby preventing inclination or displacement due to subsidence during drilling;

S5: adjusting the verticality of the drilling rig: in order to ensure the verticality of pile foundation after hole formation, adjusting the verticality of the drill pipe of the rig according to the level meter carried by the rig itself, so that the drill pipe of the rig corresponds to the center position of the retaining wall;

S6: lead hole drilling: setting lead holes in the retaining wall, and performing drilling based on the lead holes to form square pile drilled holes.

The step S6 of lead hole drilling specifically comprises the following two drilling methods according to different geological structures:

A. lead hole drilling method I, four-corner lead hole drilling method: for pile foundation less prone to hole collapse with stable stratum structure as revealed by the geological survey report, opening plum-blossom-shaped lead holes at four corners of the pile foundation with a φ 800 mm round pick bailing drill bit [taking the square pile with a design specification of (2.0 m×3.0 m) as an example], each lead hole being drilled to the designed hole bottom elevation;

B. lead hole drilling method II, single lead hole drilling method: for pile foundation prone to hole collapse with unstable stratum structure as revealed by the geological survey report, in order to prevent deviation of the pipe hole, drilling lead holes in the pile foundation in the distal direction deviated from the drilling rig with a φ 1500 mm round pick bailing drill or drill bit [taking the square pile with a design specification of (2.0 m×3.0 m) as an example] until the designed hole bottom elevation according to the topography and site conditions.

S7: Reamed hole drilling: continuing to drill reamed holes on the basis of lead hole drilling, and forming preformed holes after lead hole drilling and reamed hole drilling.

According to different geological structures, the reamed hole drilling specifically comprises the following two hole forming methods, which respectively correspond to the methods I and II of the step S6:

A. reamed hole drilling method I, four-corner lead hole drilling method: for pile foundation having plum-blossom-shaped lead holes and stable stratum structure, drilling in the center of the square pile by the rotary drilling rig with a φ 2000 mm round pick bailing drill until the designed pile bottom elevation and forming a preformed hole (corresponding to the method I of the step 6: four-corner lead hole drilling method);

B. reamed hole drilling method II, single lead hole drilling method: for pile foundation having a single lead hole which is prone to hole collapse with unstable stratum structure as revealed by the geological survey report, drilling the square pile at the proximate end that is near the rotary drilling rig with a φ1500 mm or φ1800 mm round pick bailing drill until the designed pile bottom elevation and forming a preformed hole (corresponding to the method II of the step 6: single lead hole drilling method).

Since the geological structure of pile foundation adopting the single lead hole drilling method is relatively unstable, if the hole collapse is serious during drilling, a slurry retaining wall or steel casing retaining wall for deep foundation square pile should be adopted reasonably and timely to follow up the construction.

S8: Square hole drilling: performing square hole drilling after preformed holes are formed by the lead hole drilling and reamed hole drilling of the drilling rig described above, and converting the lateral rotational kinetic energy into longitudinal rotational kinetic energy through the conversion of the kinetic energy transmission component mechanism by using the kinetic energy of the drilling rig, and then performing digging and trimming treatment by the actuating component mechanism of the square pile drill bit. In the process of square hole drilling, if pile casing is required because of serious hole collapse, each side should be enlarged by 100 mm according to the design specification, and the square steel casing should be made with the length corresponding to the hole collapse depth and lowered below the hole collapse elevation, so as to serve as a retaining wall and prevent hole collapse. Because a large amount of sediment falls from the hole wall to the bottom of the preformed hole during the square hole drilling process, and the square pile drill bit does not have the function of sediment fishing; sediment fishing using a round drill bit and square hole drilling should be repeatedly for several times during the square hole drilling process until the square hole is drilled to the designed hole bottom elevation.

S9: Hole cleaning with circular drill bit: after the step S8, cleaning sediment at the bottom of the hole; first cleaning the sediment at four corners with a φ 800 mm hole cleaning drill bit, then cleaning the whole bottom of the hole with a φ 2000 mm hole cleaning drill bit, and repeatedly sweeping the bottom of the hole from one end to the other end until the sediment at the bottom of the hole is basically cleaned up.

S10: Hole cleaning with square drill bit: continuing to clean the sediment at the bottom of the hole with a square drill bit for hole cleaning; the principle of hole cleaning with the square drill bit is to use a movable connecting rod combined with double loose-leaf sediment clamping plates to slowly pull the central movable connecting rod under the strong self-gravity of the hole cleaner, so that the double loose-leaf sediment clamping plates are automatically closed to scrape all the sediment at the bottom of the hole to the center at the bottom of the hole and form an inverted triangular sediment clamping space, and then, the square pile hole cleaner is pulled by the drill pipe of the rotary drilling rig. This step can be repeated for many times to clean the sediment at the bottom of the hole until the sediment at the bottom of the hole is completely removed.

S11: Measuring the sediment: after the hole cleaning by the square drill bit is finished, measuring the sediment at the bottom of the hole by using a sediment tray, and proceeding to the next process only after it is qualified; and if it is unqualified, the hole will be cleaned twice or for several times, or the round drill bit for hole cleaning may be used for repeated hole cleaning.

S12: Fabricating and installing a reinforcing cage: preparing and preliminarily manufacturing the reinforcing cage according to the design requirements in the special processing factory; and performing binding, welding and molding at the construction site.

In the step S12, the construction points of fabrication and installation of the reinforcing cage are as follows: the diameter and reinforcement specifications of the reinforcing cage meet the design requirements; thickness of the protective layer of the reinforcing cage is 50 mm; the section of the main reinforcement cannot be damaged when welding; the fabrication and storage areas should be kept flat, clean, covered with underlay at both upper and lower sides, and being rainproof and waterproof.

Hoisting and installation of the reinforcing cage: the reinforcing cage can be hoisted and placed only after passing the acceptance inspection, and the inspection contents comprise: the length and diameter of the cage should meet the requirements; whether the welding of the hoisting skeleton at the top of the reinforcing cage meets requirement of safety hoisting construction, and whether the length of the longitudinal reinforcement of the supporting pile anchored into the crown beam meets the design requirements, the square pile reinforcing cage should be hoisted in parallel with the four-corner support hoisting skeleton, and it should be hoisted high and lowered slowly when it is hoisted and lowered, and meanwhile, special persons should be assigned to straighten the square pile reinforcing cage around the reinforcing cage, so as to avoid scratching of the hole wall of the square pile as much as possible, thereby preventing the debris from falling from the hole wall and forming the sediment at the bottom of the hole.

S13: Pouring concrete: adopting underwater concrete pouring method for concrete pouring, wherein two sets of conduits are used for construction at the same time due to the relatively large designed cross section of the square pile, and the process comprises: putting crane in place, measuring hole depth, calculating conduit length, laying conduits and pouring concrete.

The conduit length is determined according to the hole depth actually measured, and a discharging gap at the bottom of the hole is controlled at 200 mm~400 mm from the lower end of the conduit to the bottom of the hole during construction.

Initial pouring requirements: the initial pouring amount is a key index of concrete pouring, and after initial pouring, the embedded depth of the conduit should be ensured to be not less than 2.0 m.

Concrete pouring: The strength of concrete adopts underwater concrete according to the design requirements, and the mixing ratio shall be provided by the mixing station and strictly implemented. After each concrete pouring, the rising height of the concrete surface should be measured in time; the buried depth of the conduit should be calculated; the conduit should be dismantled in time, and the buried depth of the conduit is preferably not greater than 8.0 m. The embedded depth of the conduit shall not be less than 3.0 m after each dismantling of the conduit. When it is confirmed that the concrete is poured to the top of the pile, the elevation of the concrete surface should be carefully detected, and the conduit can be lifted only after it is confirmed to be qualified. In the process of concrete pouring, manpower and material resources should be organized well to perform pouring continuously without intermediate pause, and underwater concrete pouring should be completed in the shortest time. The last pouring amount should be controlled and the pile top should not be low even slightly, and a laitance layer, which is in contact with concrete, on the upper layer of concrete needs to be chipped away. Therefore, the height of concrete needs to be over-poured by 500 mm, and the part above the designed elevation should be chipped away with manpower or manpower combined with an air pick, and the pouring process shall be well recorded by a pouring recorder.

In the process of concrete pouring, in case of a pile foundation embedded with square steel casing, an appropriate over-pouring coefficient should be calculated according to the volume of casing and conditions of the hole collapse outside the casing for appropriate over-pouring, and the steel casing is pulled out by cranes or other machines in real time after concrete pouring is completed. After 48 hours from the completion of concrete pouring, the part above the designed pile top elevation is chipped away with manpower or manpower combined with an air pick according to design requirements to complete the removal of pile head. Then pile maintenance and construction are completed after detection of pile foundation is performed only after the maintenance period is reached according to the requirements of relevant specifications.

A second objective of the present invention is to provide a new square pile drill bit (mainly used in the step S8 of the above-mentioned construction method) in cooperation with the above-mentioned construction method.

An embodiment of the square pile drill bit is a square pile drill bit for square drilling of poured pile foundation as shown in FIG. 2 to FIG. 10. It shall be noted that: "poured" as used in "poured pile foundation" here does not specifically refer to a certain process, let alone S13 in the above-mentioned construction method, but represents the form of pile formation as "pile formation by pouring". The square pile drill bit used here is mainly used in the step S8 of the above-mentioned construction method. The square pile drill bit comprises a box body 14, and the box body 14 is installed with a power driving device, a power transmission mechanism and an actuator. The box body 14 is cuboid. The power driving device comprises a first power transmission shaft 18, a power input first connecting square head 11, a lifting pressure plate 15 and a pressure conducting plate 12. The middle of the box body 14 is installed with the first power transmission shaft 18, and the first power transmission shaft 18 is rotatably connected with the box body 14 through a bearing 17. The number of the bearings 17 is two, and the two bearings 17 are respectively located in the round holes of the upper and lower wall plates of the box body 14, and the upper and lower sides of the bearing 17 are respectively provided with a first bearing pressure plate 13 and a second bearing pressure plate 16. The first bearing pressure plate 13, the second bearing pressure plate 16 and the box body 14 are connected by screws. The bearing 17 is installed between the first bearing pressure plate 13 and the second bearing pressure plate 16, and the bearing 17 is fixed by the first bearing pressure plate 13 and the second bearing pressure plate 16. The upper end of the box body 14 is connected with the lifting pressure plate 15 by screws. The upper outer wall of the first power transmission shaft 18 is provided with a shoulder 130, which is located in the lifting pressure plate 15. The lower side of the shoulder 130 is provided with the pressure conducting plate 12, and the pressure conducting plate 12 is fixedly connected to the upper side of the box body 14. The shoulder 130 is integrally formed with the first power transmission shaft 18, and thus the structure is stable.

Figure 3:
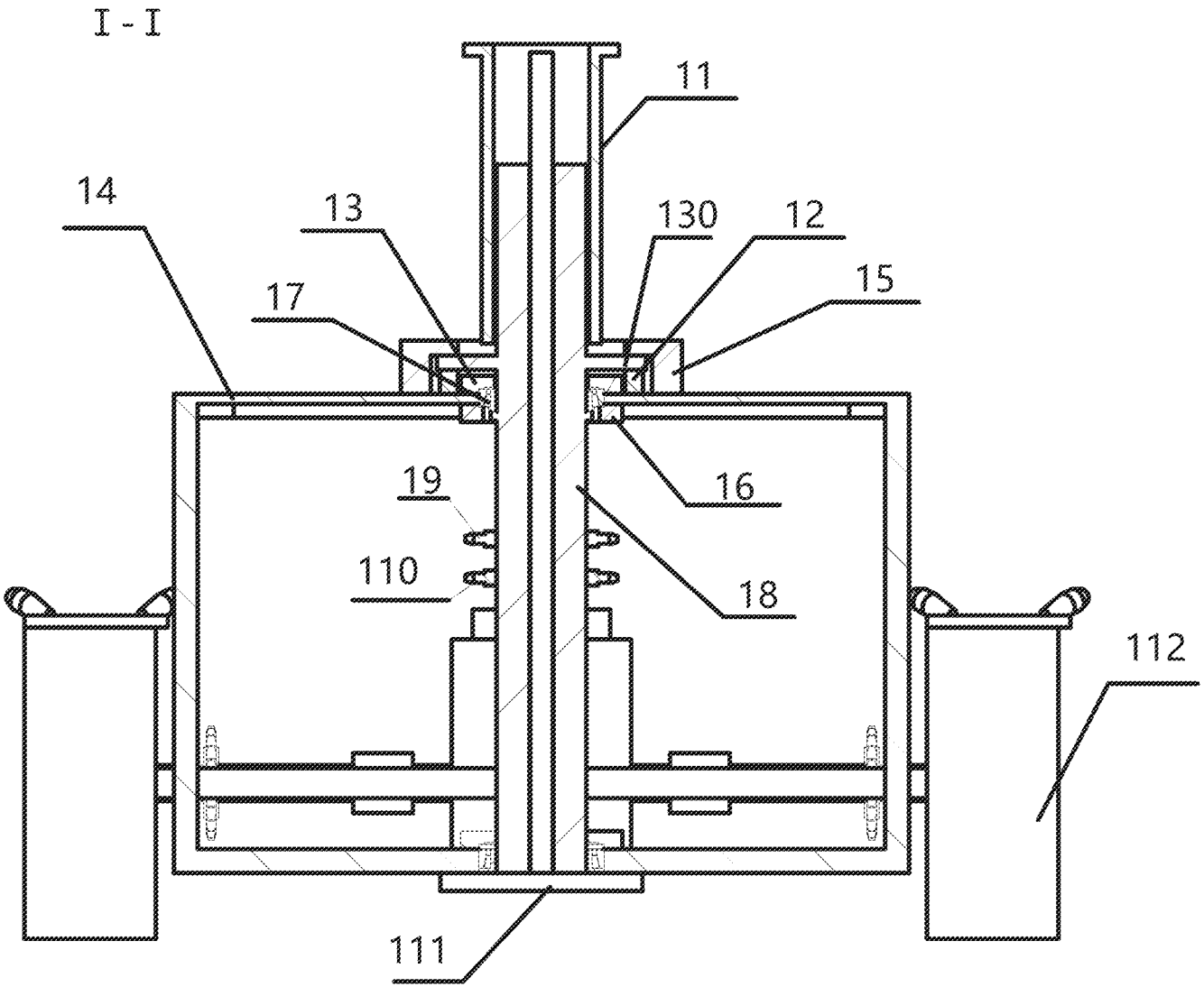
FIG. 3 is a schematic view of a sectional structure along line A-A of FIG. 2.
Figure 4:
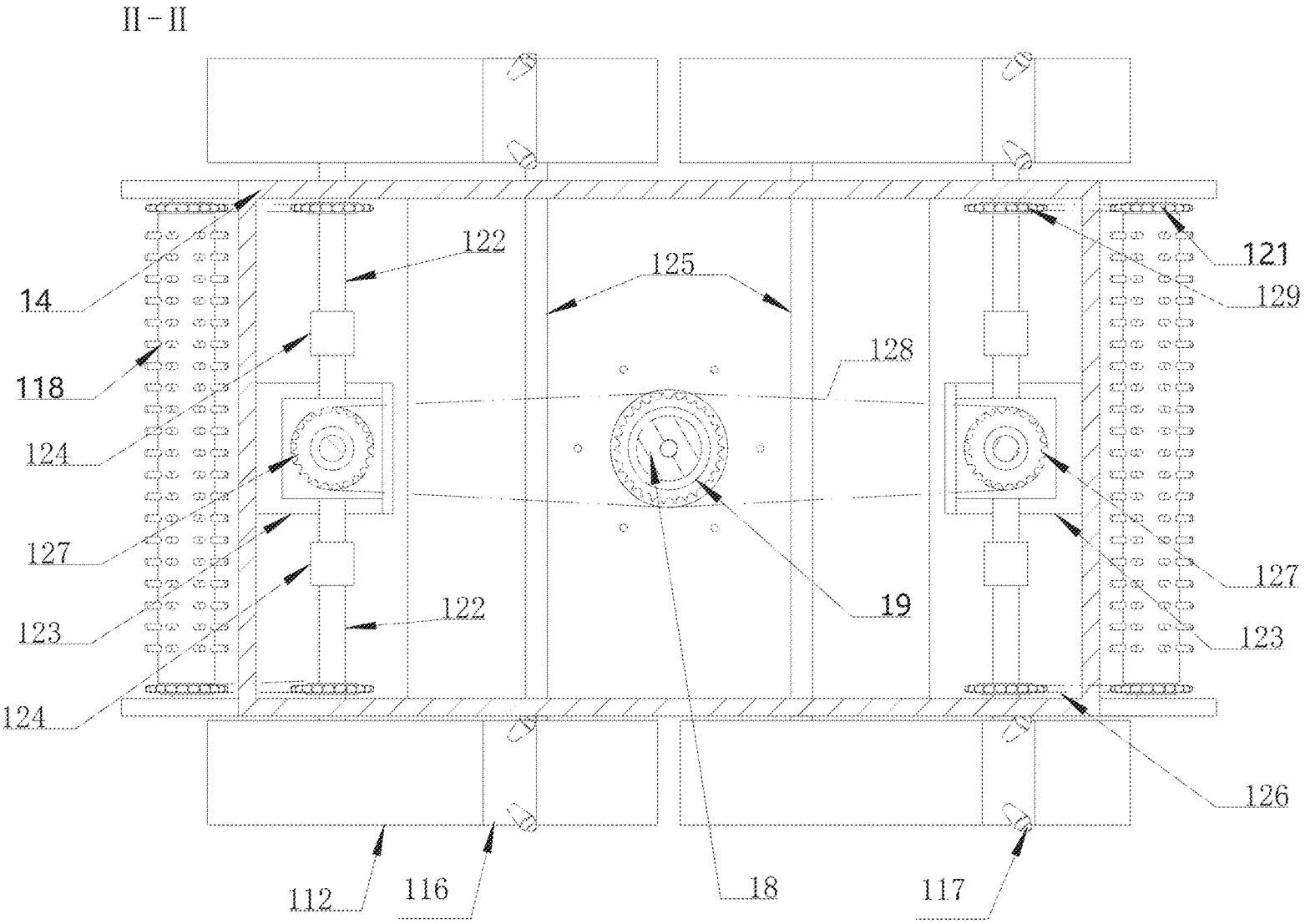
FIG. 4 is a schematic view of a sectional structure along line B-B of FIG. 2.

As shown in FIG. 3 and FIG. 4, the upper side of the first power transmission shaft 18 is fixedly connected with the power input first connecting square head 11. During use, the square pile drill bit is connected to the existing rotary drilling rig through the first connecting square head 11, and the rotary drilling rig drives the first connecting square head 11 to rotate for power input.

The power driving device is connected with a power transmission mechanism, and the power transmission mechanism comprises first driving sprockets 19, second driving sprockets 110, power input sprockets 127, first chains 128, reversing transmission boxes 123, transmission shafts 122, first sprockets 129, second sprockets 121 and second chains 126. The middle of the first power transmission shaft 18 is connected with the first driving sprocket 19 and the second driving sprocket 110 by screws. The first driving sprocket 19 is located on the upper side of the second driving sprocket 110. Both the left and right sides of the inner cavity of the box body 14 are connected with the reversing transmission box 123 through bolts. The reversing transmission boxes 123 are T-shaped reversing transmission boxes, such as T-series spiral bevel gear diverter, which belong to a mature existing technology. The transmission mode of the reversing transmission box 123 is speed reduction transmission, which is a mature existing technology, and the match ratio (speed ratio) simply needs be adjusted according to the gear size. The controllable reduction of rotational speed can be realized by adopting the speed reduction transmission. The upper end of the input shaft of the reversing transmission box 123 is connected with the power input sprocket 127 through screws, the power input sprocket 127 on the left side is at the same height as the first driving sprocket 19, and the power input sprocket 127 on the right side is at the same height as the second driving sprocket 110. It shall be noted that in FIG. 4, the first driving sprocket 19 and the second driving sprocket 110 overlap, and only the first driving sprocket 19 is shown. The first chain 128 is respectively installed between the power input sprocket 127 on the left side and the first driving sprocket 19, and between the power input sprocket 127 on the right side and the second driving sprocket 110. Both the front and rear sides of the reversing transmission box 123 are provided with an output shaft, and the output shaft of the reversing transmission box 123 is connected with the transmission shaft 122 via a shaft coupler 124.

The power transmission mechanism is connected with the actuator which comprises first actuating components 118 and second actuating components 112. Both the left and right sides of the lower part of the box body 14 are installed with the first actuating component 118. The first actuating component 118 is in transmission connection with the transmission shaft 122 through the first sprocket 129, the second sprocket 121 and the second chain 126. Ends of the transmission shafts 122 away from the box body 14 are all installed with the second actuating components 112.

Figure 5:
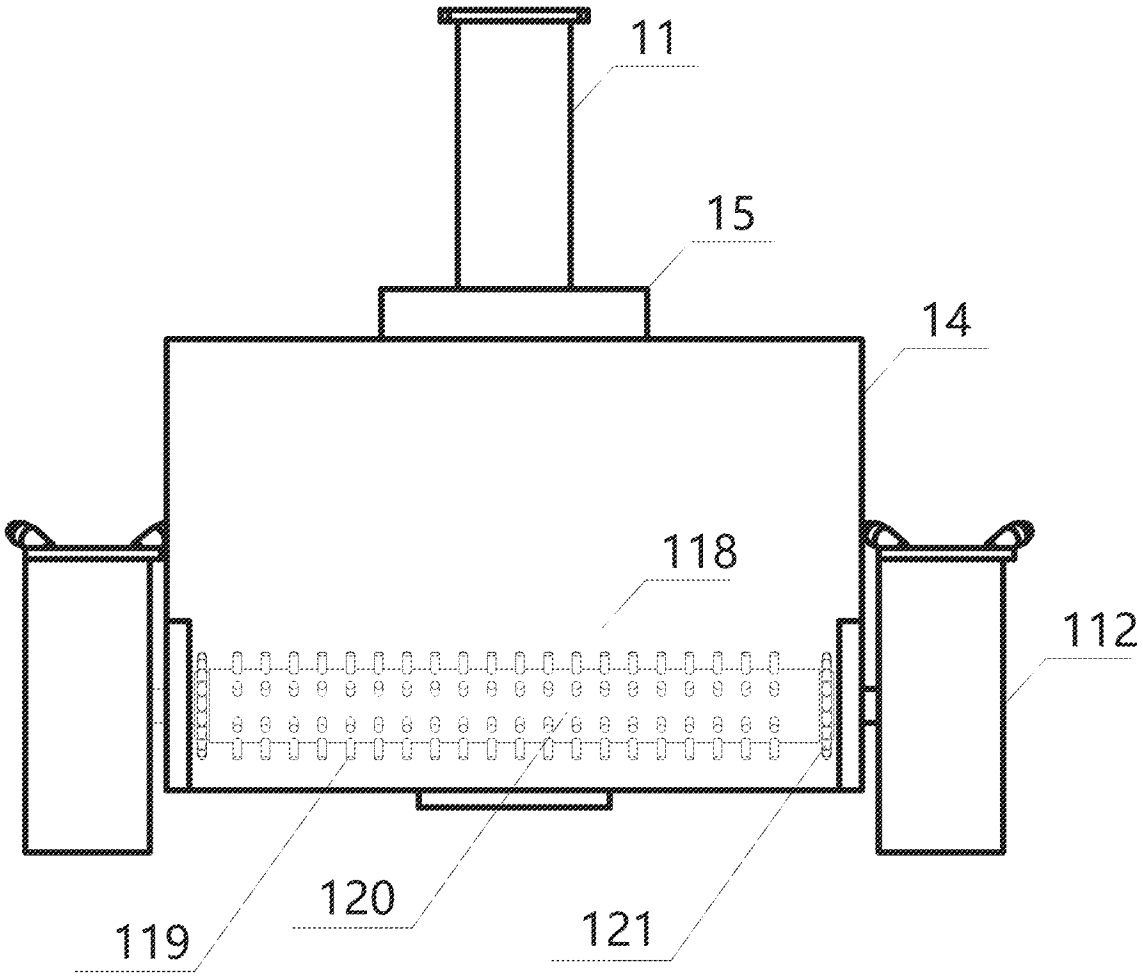
FIG. 5 is a schematic view of the structure of FIG. 2 viewed at the right side.
Figure 9:
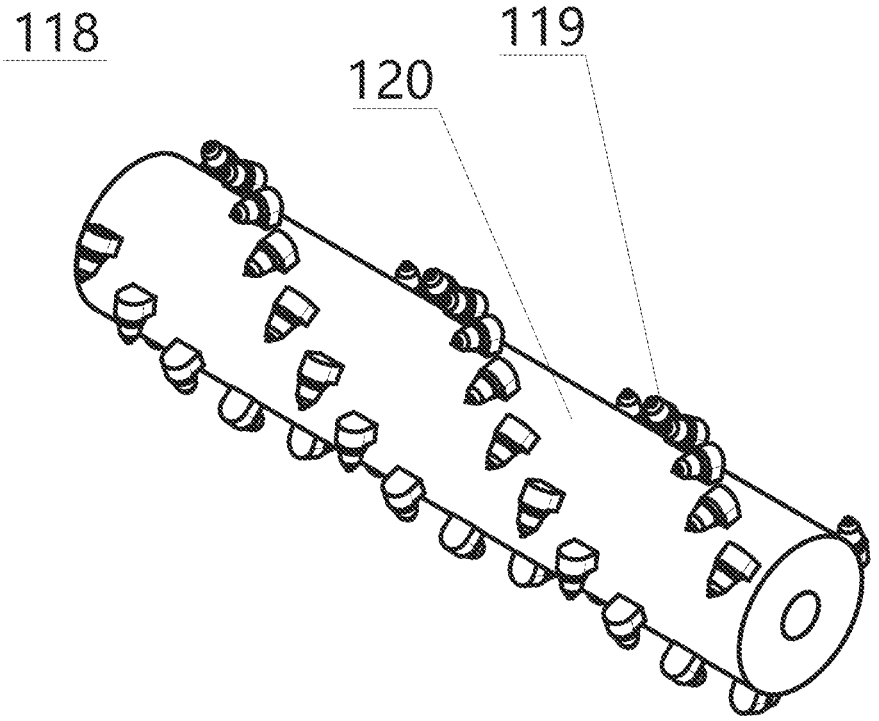
FIG. 9 is a schematic view of a first actuating component of the square pile drill bit of FIG. 2 according to another embodiment.

As shown in FIG. 4 and FIG. 5, the first actuating component 118 comprises a rotating shaft 120 and a first digging actuating element 119. The first digging actuating element 119 has a hard convex structure. The rotating shaft 120 is rotatably connected with the box body 14, and the outer wall of the rotating shaft 120 is fixedly connected with the first digging actuating element 119. Both the front and rear ends of the rotating shaft 120 are installed with the second sprocket 121. The transmission shaft 122 is connected with the first sprocket 129 by screws, and the position of the first sprocket 129 and the position of the second sprocket 121 are in left-and-right correspondence. The second chain 126 is installed between the first sprocket 129 and the second sprocket 121, and the transmission shaft 122 drives the rotating shaft 120 to rotate through the second chain 126. The first digging actuating element 119 arranged by the first actuating component 118 is a hard protrusion, preferably a protrusion with the shape of a "bullet". The first digging actuating elements 119 may be arranged evenly and parallel to the rotating shaft 120 as shown in FIG. 4 and FIG. 5. Alternatively, the first digging actuating elements 119 may be distributed spirally on the surface of the rotating shaft 120 as shown in FIG. 9. The preferred solution is that the gap between respective first digging actuating elements 119 is 10 to 20 mm.

Figure 6:
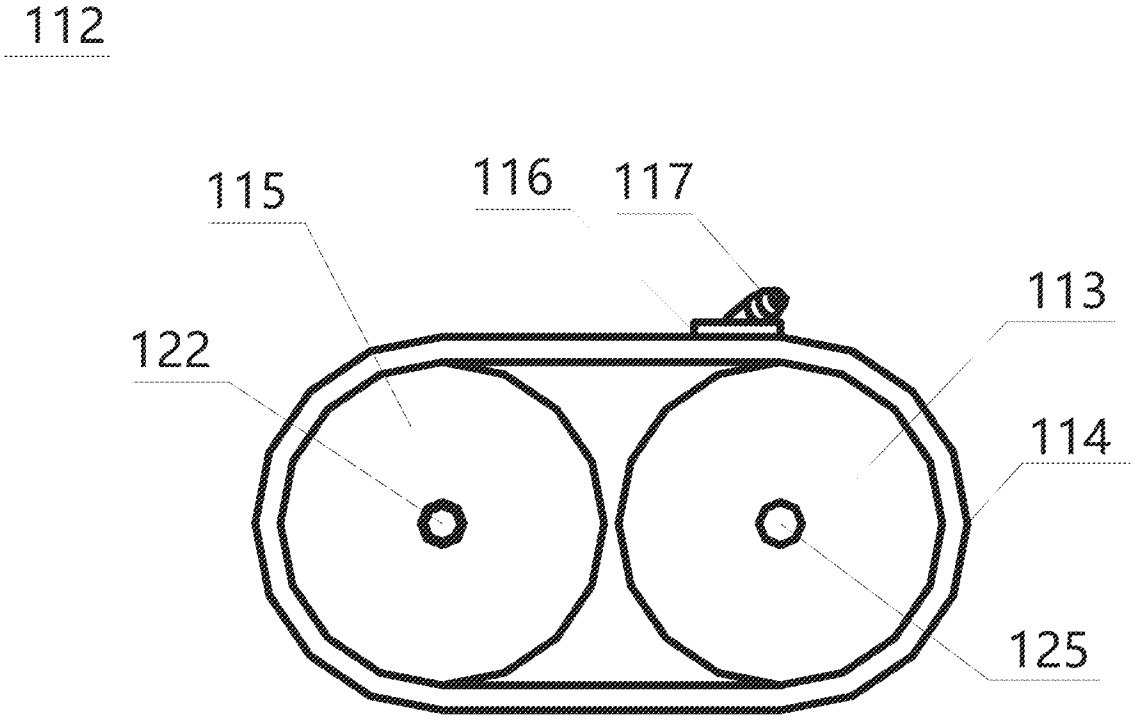
FIG. 6 is a schematic structural view of a second actuating component of the square pile drill bit of FIG. 2 according to one embodiment.
Figure 7:
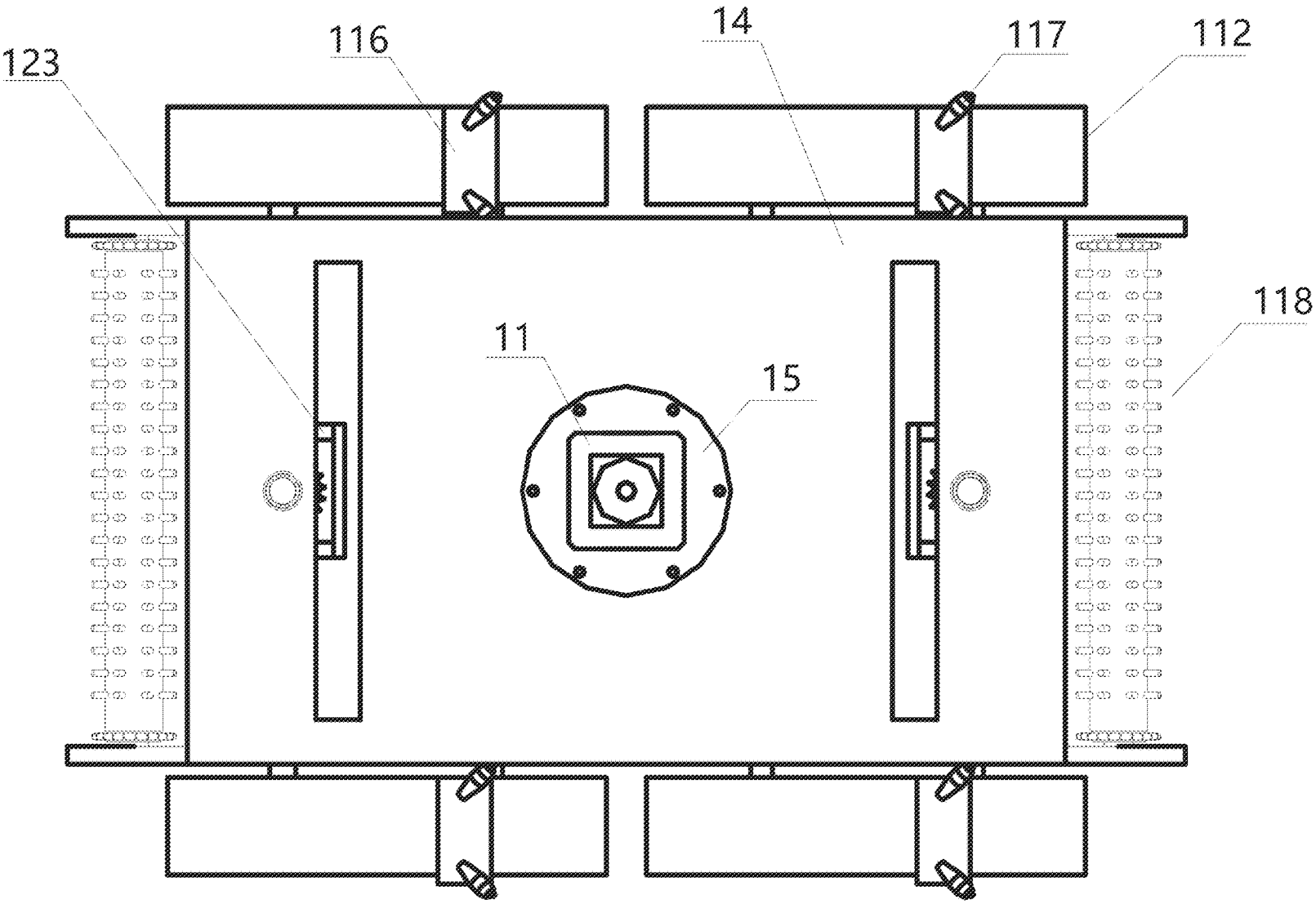
FIG. 7 is a schematic top view of the structure of FIG. 2.
Figure 8:
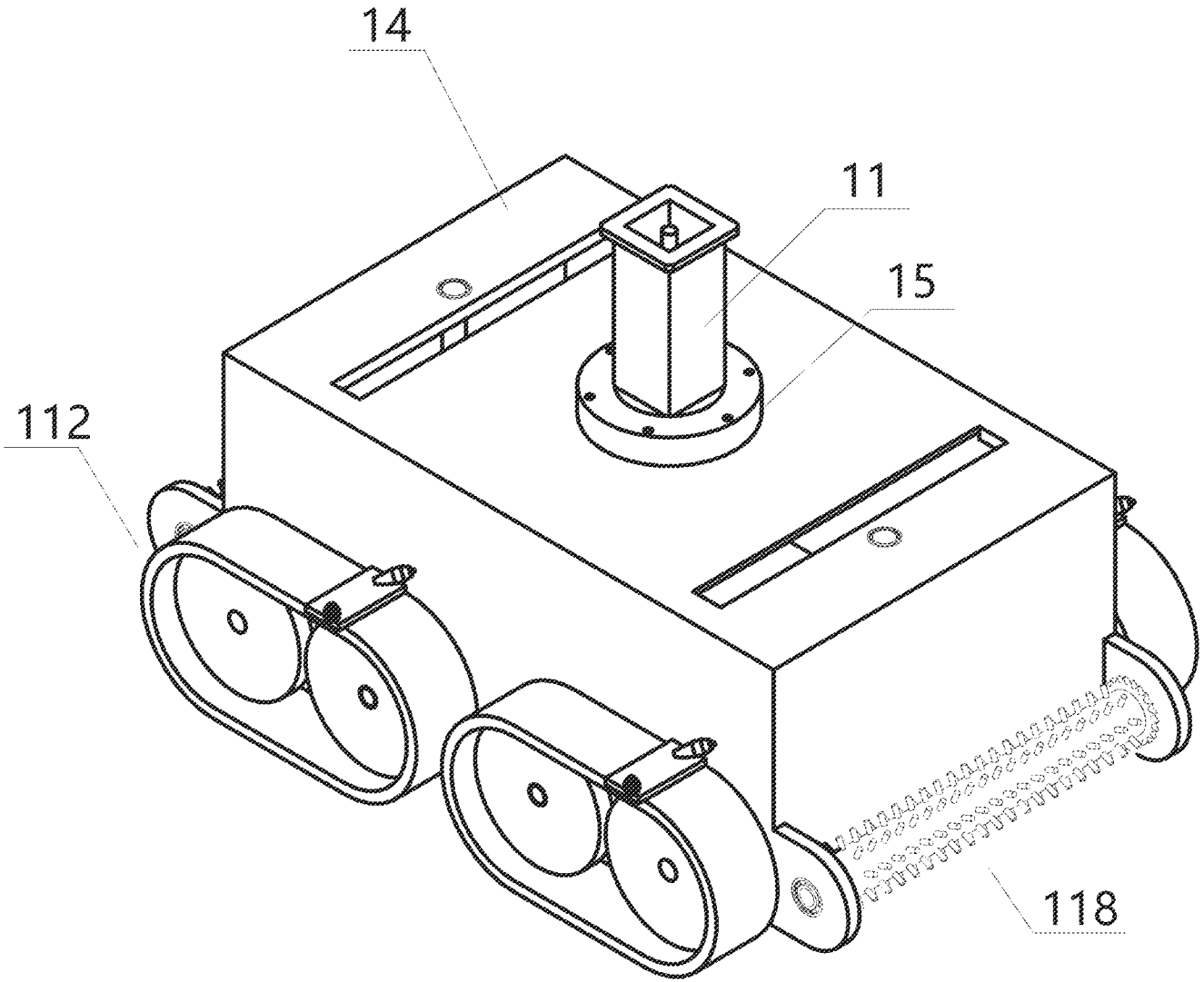
FIG. 8 is a schematic perspective view of the structure of FIG. 2.
Figure 10:
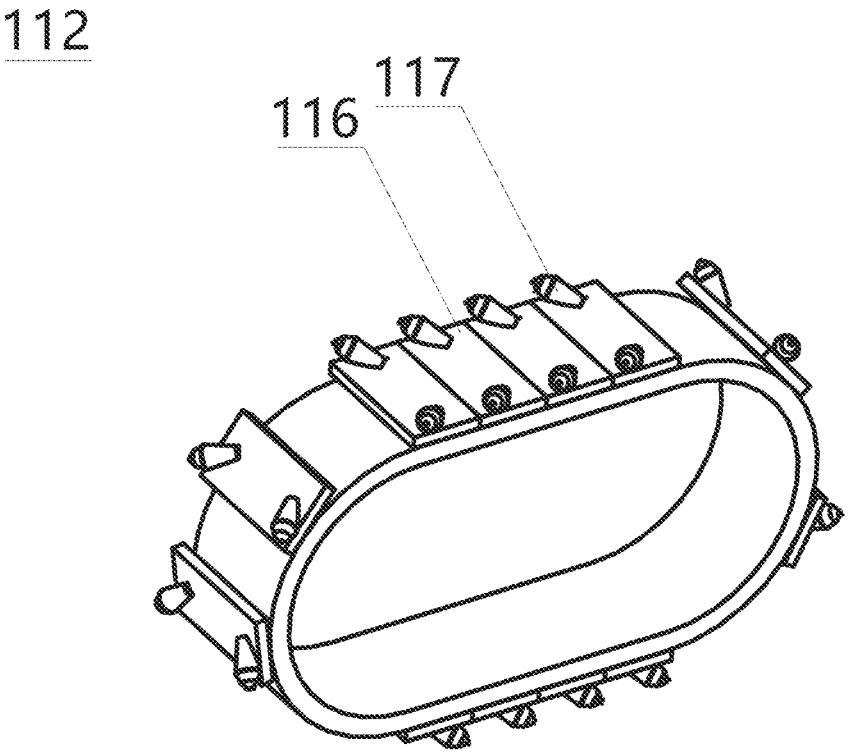
FIG. 10 is a schematic view of a second actuating component of the square pile drill bit of FIG. 2 according to another embodiment.
Figure 11:
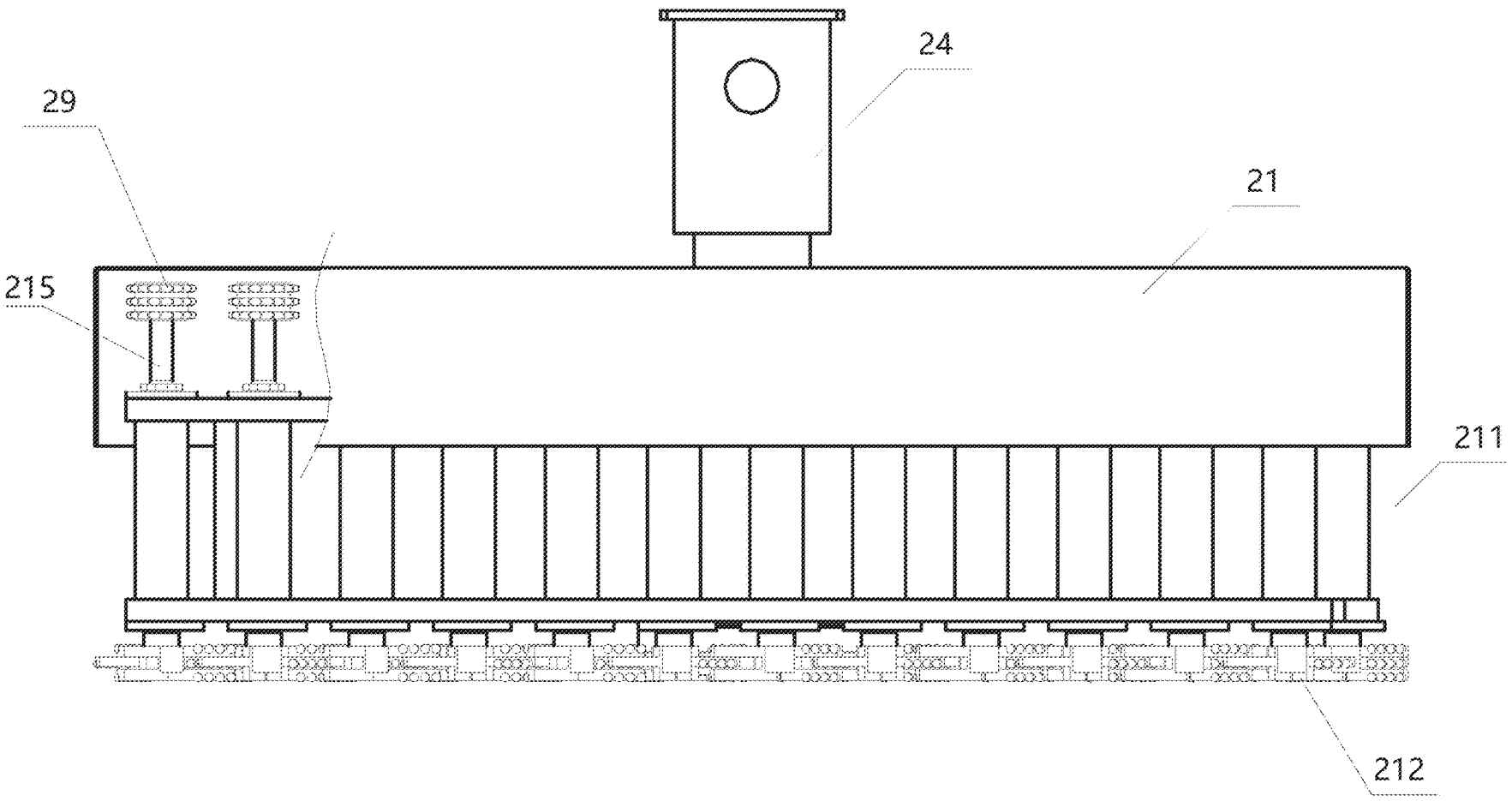
FIG. 11 is a schematic structural view of a square pile drill bit according to a second embodiment of the present invention.

As shown in FIG. 4 and FIG. 6, the second actuating component 112 comprises a crawler-type driving wheel 115, a crawler-type driven wheel 113, a crawler chain rail 114, a second digging actuating element 117, a power plate 116 and a driven shaft 125. The crawler-type driving wheel 115 is connected with one end of the transmission shaft 122 away from the box body 14 by screws. Both the left and right sides of the lower part of the box body 14 are rotatably connected with the driven shaft 125, and both the front and rear ends of the driven shaft 125 are connected with the crawler-type driven wheel 113 through bolts. The position of the crawler-type driving wheel 115 and the position of the crawler-type driven wheel 113 are in left-and-right correspondence, and the crawler chain rail 114 is installed between the crawler-type driving wheel 115 and the crawler-type driven wheel 113. The outer wall of the crawler chain rail 114 is fixedly connected with the power plate 116, and both the front and rear sides of the power plate 116 are welded with the second digging actuating element 117. The transmission shaft 122 drives the crawler-type driving wheel 115 to rotate, so that the crawler chain rail 114 rotates, and the second digging actuating element 117 rotates together with the crawler chain rail 114. Each of the second actuating components 112 may be provided thereon with a set of the second digging actuating elements 117 and power plate 116, or provided thereon with a plurality of sets of the second digging actuating elements 117 and power plates 116 as shown in FIG. 10. The second digging actuating element 117 is preferably with the shape of a "bullet". The preferred solution is that the orientation of the "bullet" of the second digging actuating element 117 is consistent with the rotation direction of the crawler-type driving wheel 115.

As shown in FIG. 3, the lower side of the box body 14 is connected with a lifting protection shaft 111 by screws. The lifting protection shaft 111 is located at the lower side of the first power transmission shaft 18. When the shifting pressure plate 15 breaks down, the lifting protection shaft 111 can protect the first power transmission shaft 18 from falling.

The working principle of this embodiment is as follows: when the square pile drill bit works downward, the downward pre-pressure is transmitted to the first power transmission shaft 18 through the power input first connecting square head 11, and the first power transmission shaft 18 transmits the pre-pressure to the box body 14 through the pressure conducting plate 12. When the square pile drill bit moves upward, the first power transmission shaft 18 cooperates with the lifting pressure plate 15 through the shoulder 130, and then transmits the lifting force to the box body 14. In case of power input, the first power transmission shaft 18 is in a rotating state, the box body 14 is stationary, and the power input first connecting square head 11 is driven by the power head of the rotary drilling rig to input the power source. The power transmission mechanism transmits the power on the power driving device to the actuator. The power head of the rotary drilling rig drives the first power transmission shaft 18 to rotate through the power input first connecting square head 11, and the first power transmission shaft 18 drives the power input sprocket 127 to rotate through the transmission of the first chain 128. The power input sprocket 127 drives the output shaft of the reversing transmission box 123 to rotate, then the output shaft of the reversing transmission box 123 drives the transmission shaft 122 to rotate, and the transmission shaft 122 drives the first actuating component 118 and the second actuating component 112 to operate. The transmission shaft 122 drives the rotary shaft 120 to rotate through the second chain 126, and the first digging actuating element 119 rotates together with the rotary shaft 120. Meanwhile, the transmission shaft 122 can drive the crawler-type driving wheel 115 to rotate, the crawler-type driving wheel 115 drives the crawler chain rail 114 to rotate, and the second digging actuating elements 117 rotates together with the crawler chain rail 114 for digging downward, and the square pile drill bit performs digging on the basis of the round hole to cut the wall of the hole flat.

Another embodiment of the square pile drill bit is as shown in FIG. 11 to FIG. 19. A cutting square pile drill bit comprises a power head component 21, a power transmission component 27 and third actuating components 211. The power head component 21 comprises a frame 22, a second connecting square head 24, a second power transmission shaft 25 and slewing bearings 26. Both the upper and lower sides of the middle part of the frame 22 are installed with the slewing bearing 26, and the frame 22 is rotatably connected with the second power transmission shaft 25 via the slewing bearing 26, and the upper end of the second power transmission shaft 25 is fixedly connected with the second connecting square head 24. The rotary drilling rig inputs power through the second connecting square head 24 to drive the second power transmission shaft 25 to rotate.

Figure 12:
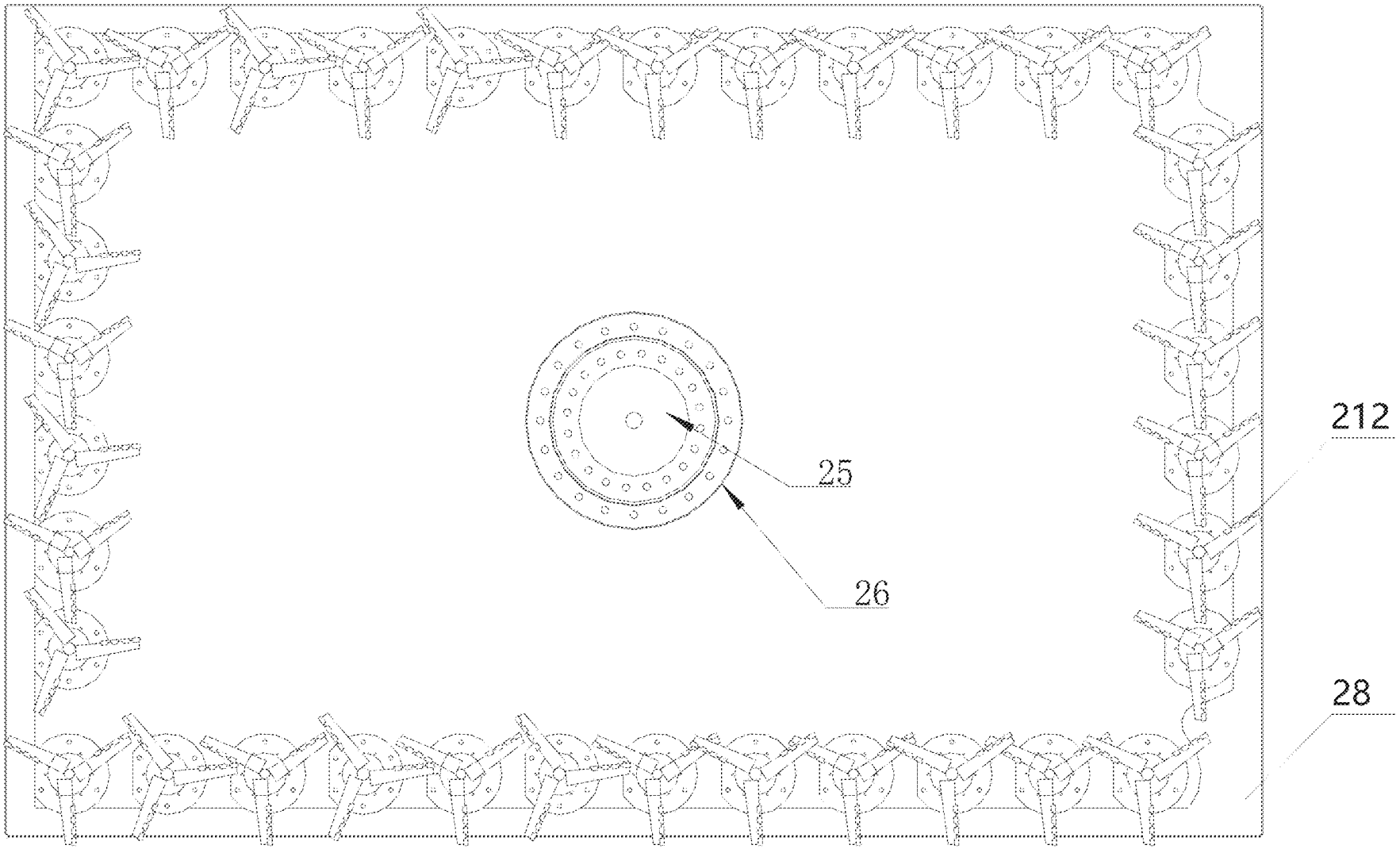
FIG. 12 is a schematic bottom view of the structure of FIG. 11.
Figure 13:
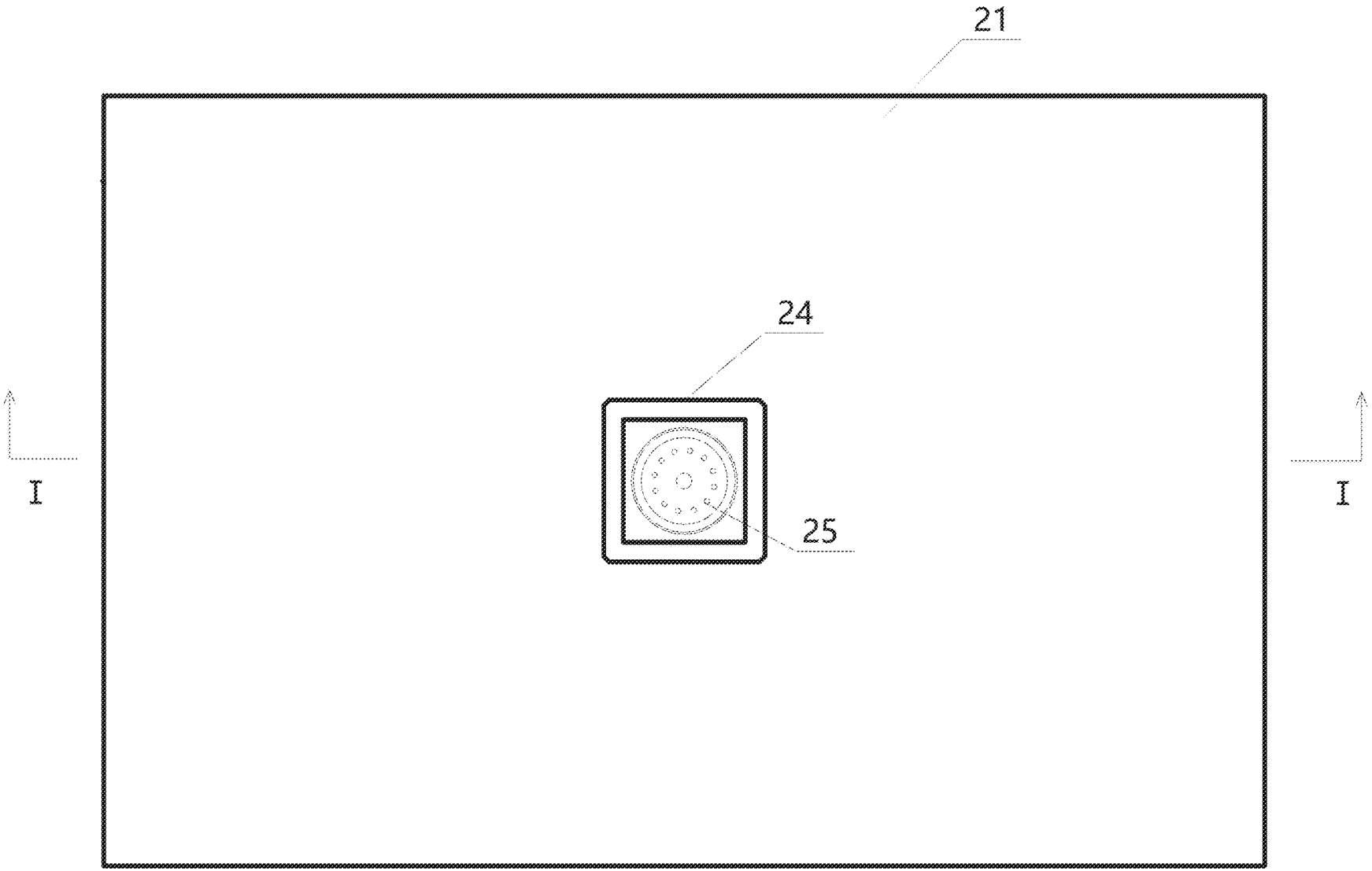
FIG. 13 is a schematic top view of the structure of FIG. 11.
Figure 17:
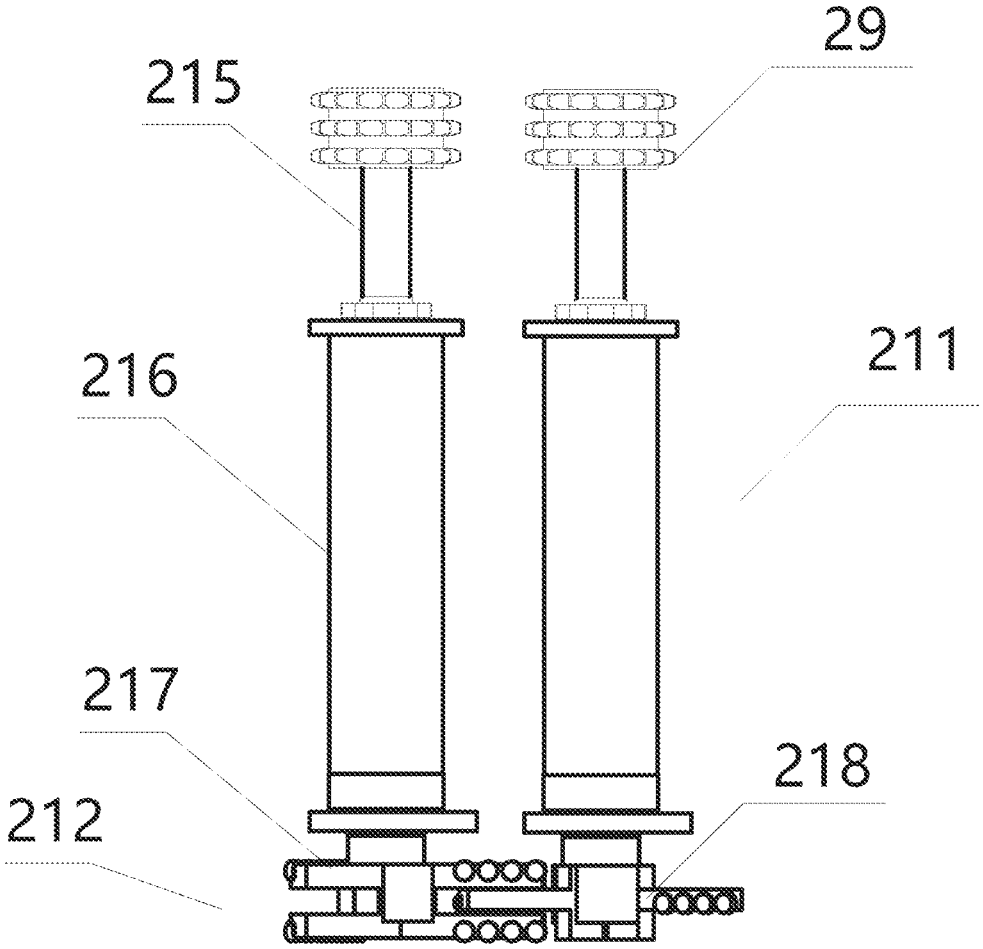
FIG. 17 is a schematic structural view of two actuating components of the square pile drill bit of FIG. 11.
Figure 18:
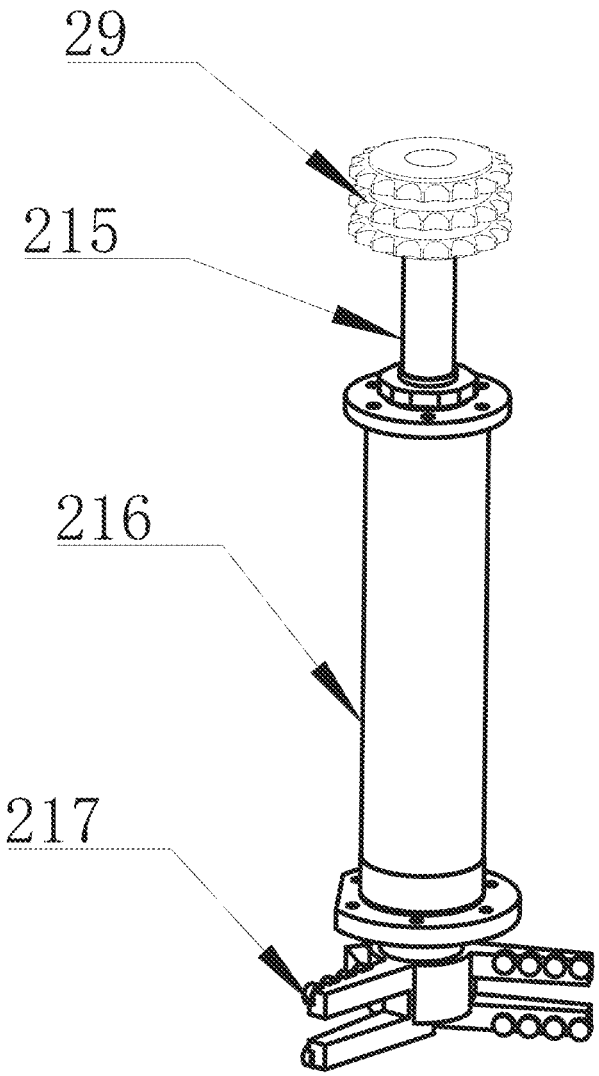
FIG. 18 is a schematic perspective view of the structure of a first cutting actuating element.
Figure 19:
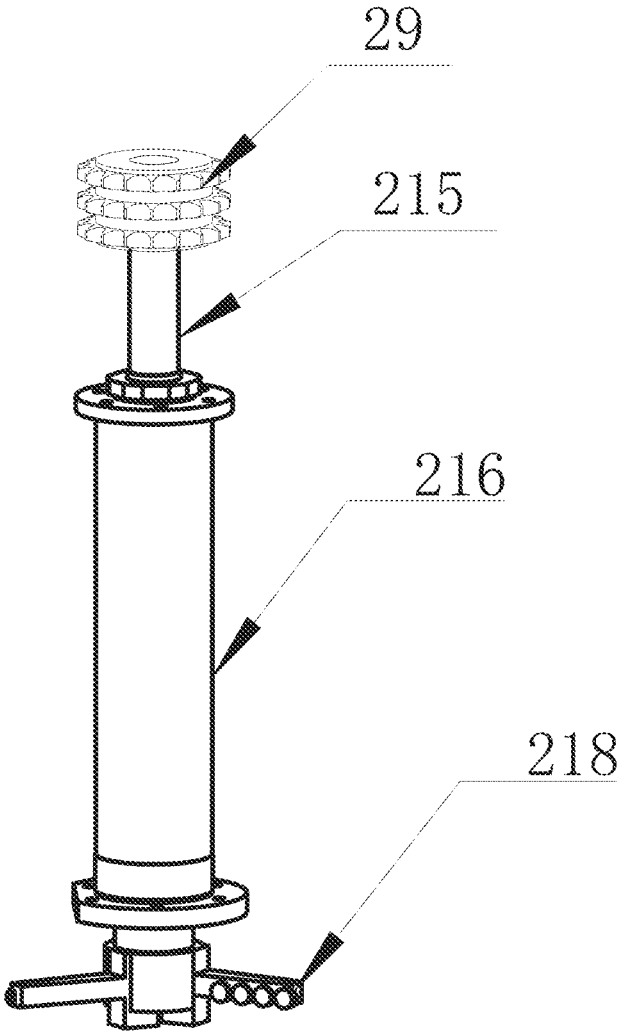
FIG. 19 is a schematic perspective view of the structure of a second cutting actuating element.
Figure 20:
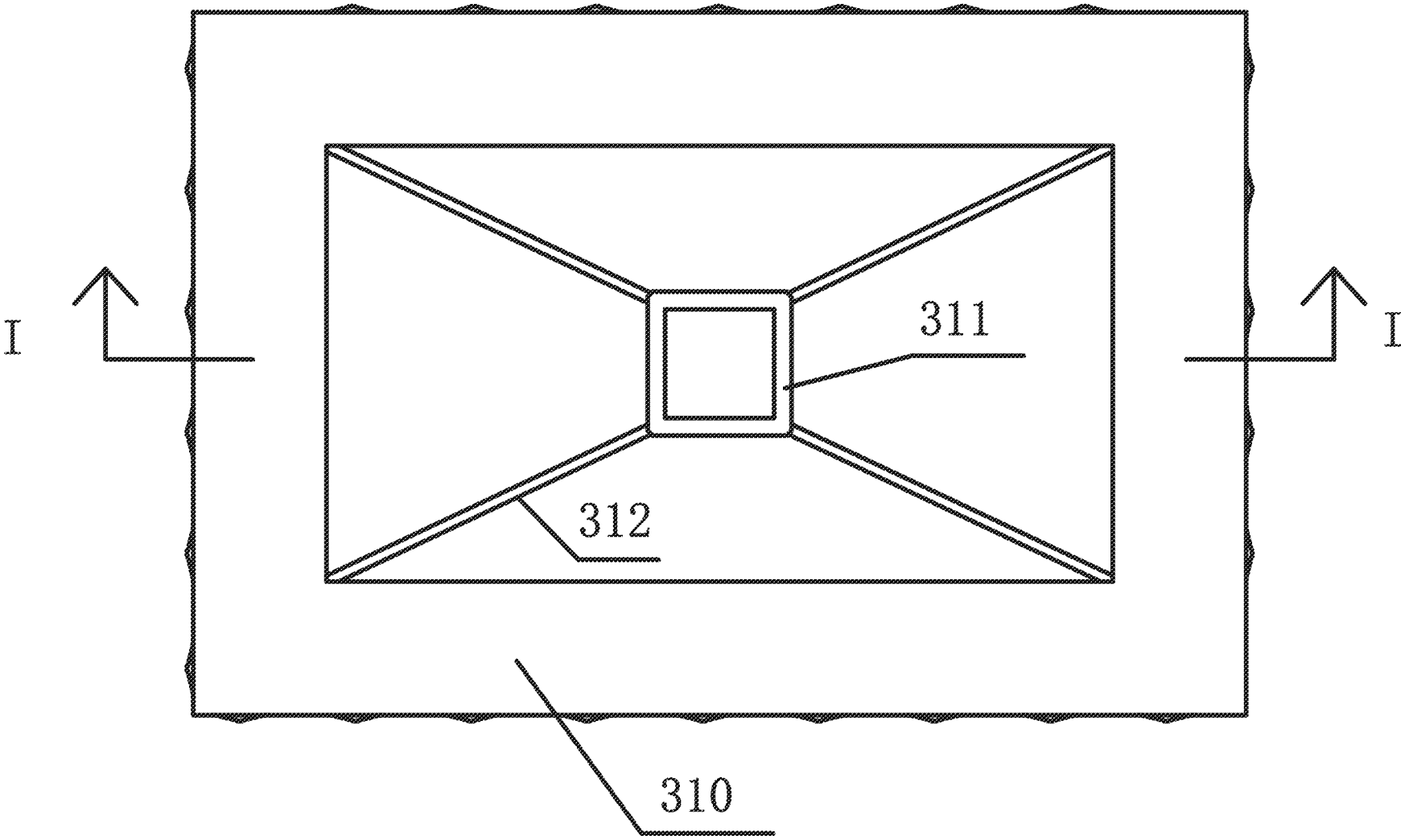
FIG. 20 is a schematic top view of the structure of a square pile drill bit according to a third embodiment of the present invention.
Figure 21:
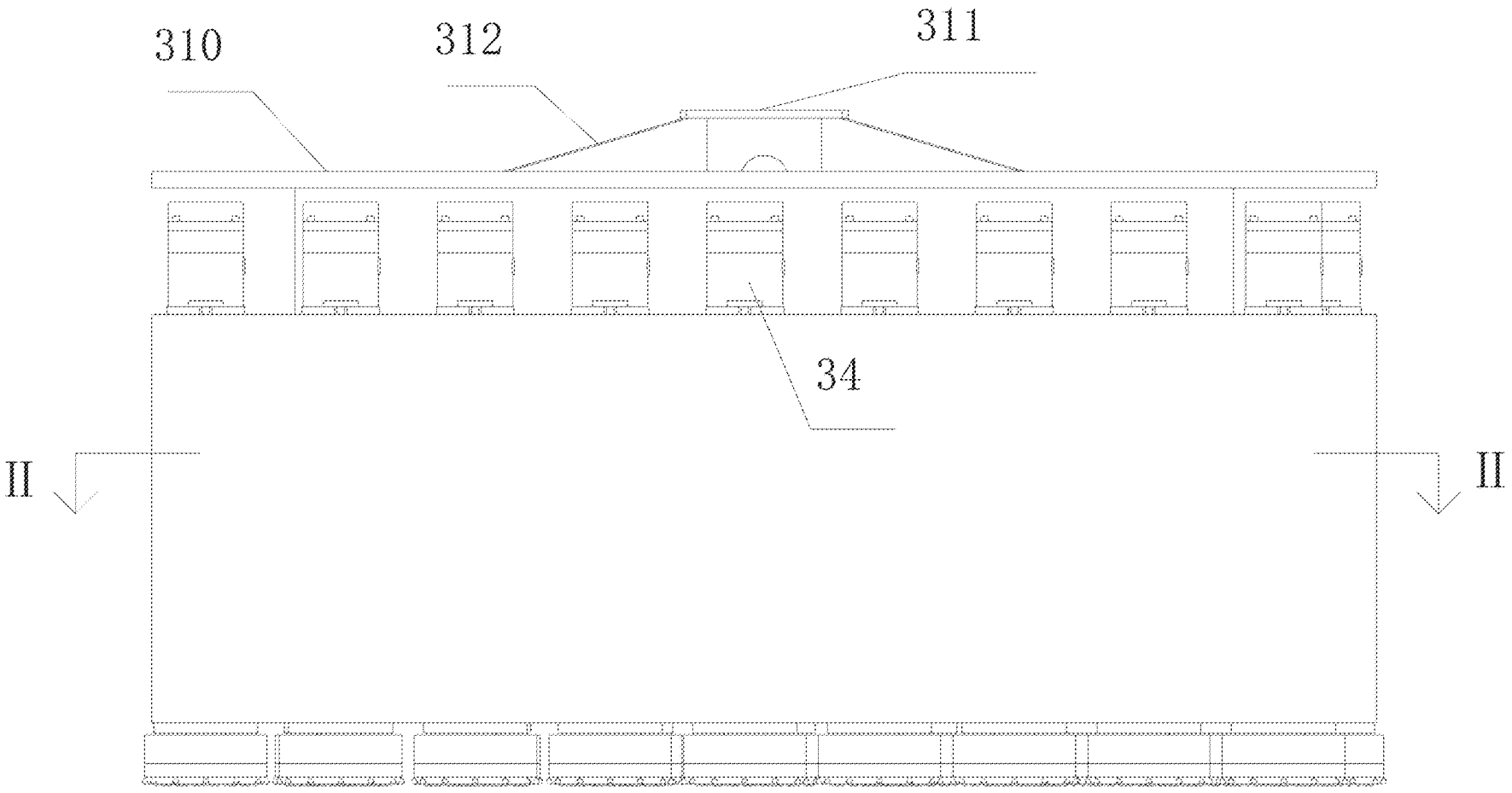
FIG. 21 is a schematic front view of the structure of FIG. 20.
Figure 22:
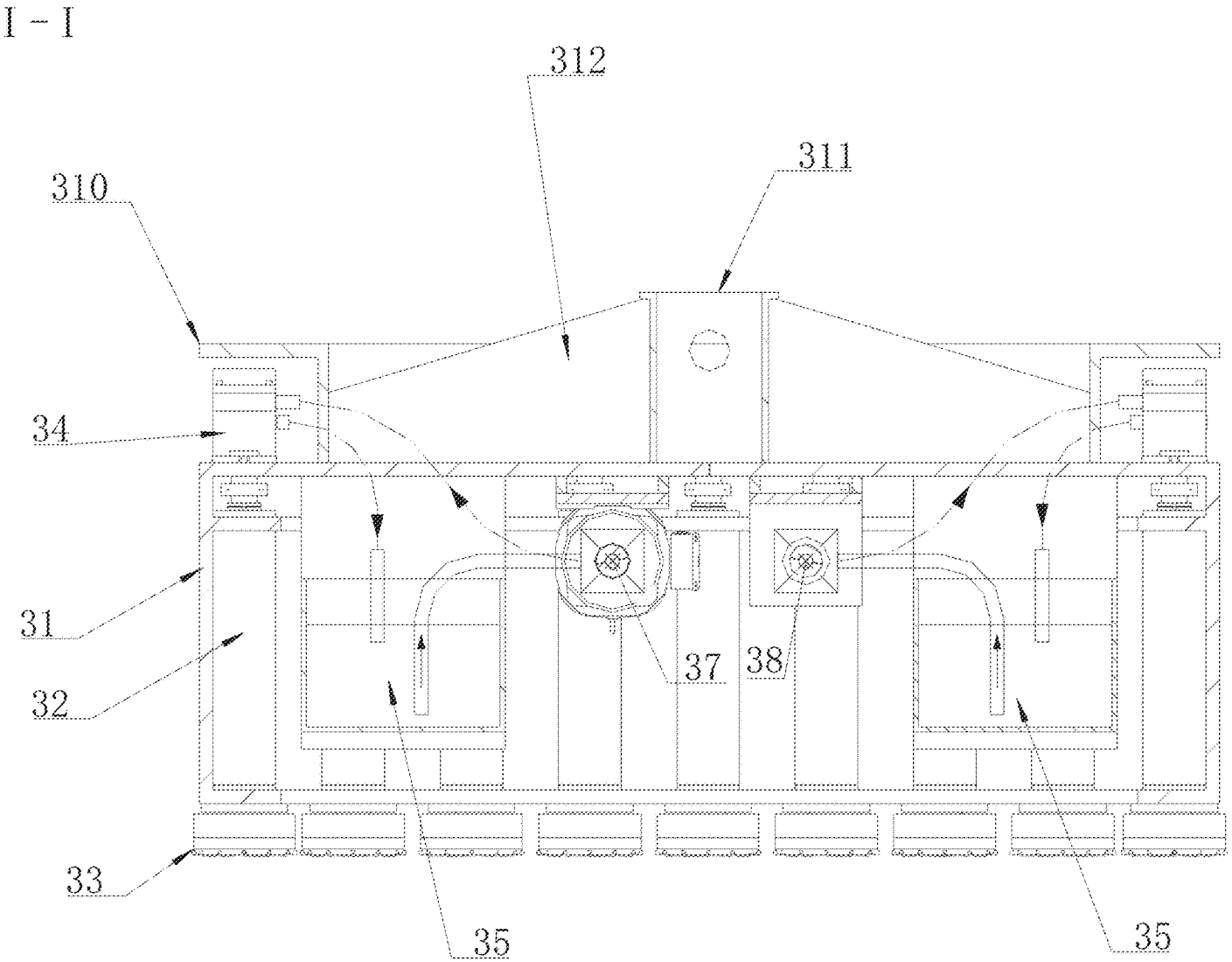
FIG. 22 is a schematic view of the sectional structure along line A-A of FIG. 20.
Figure 23:
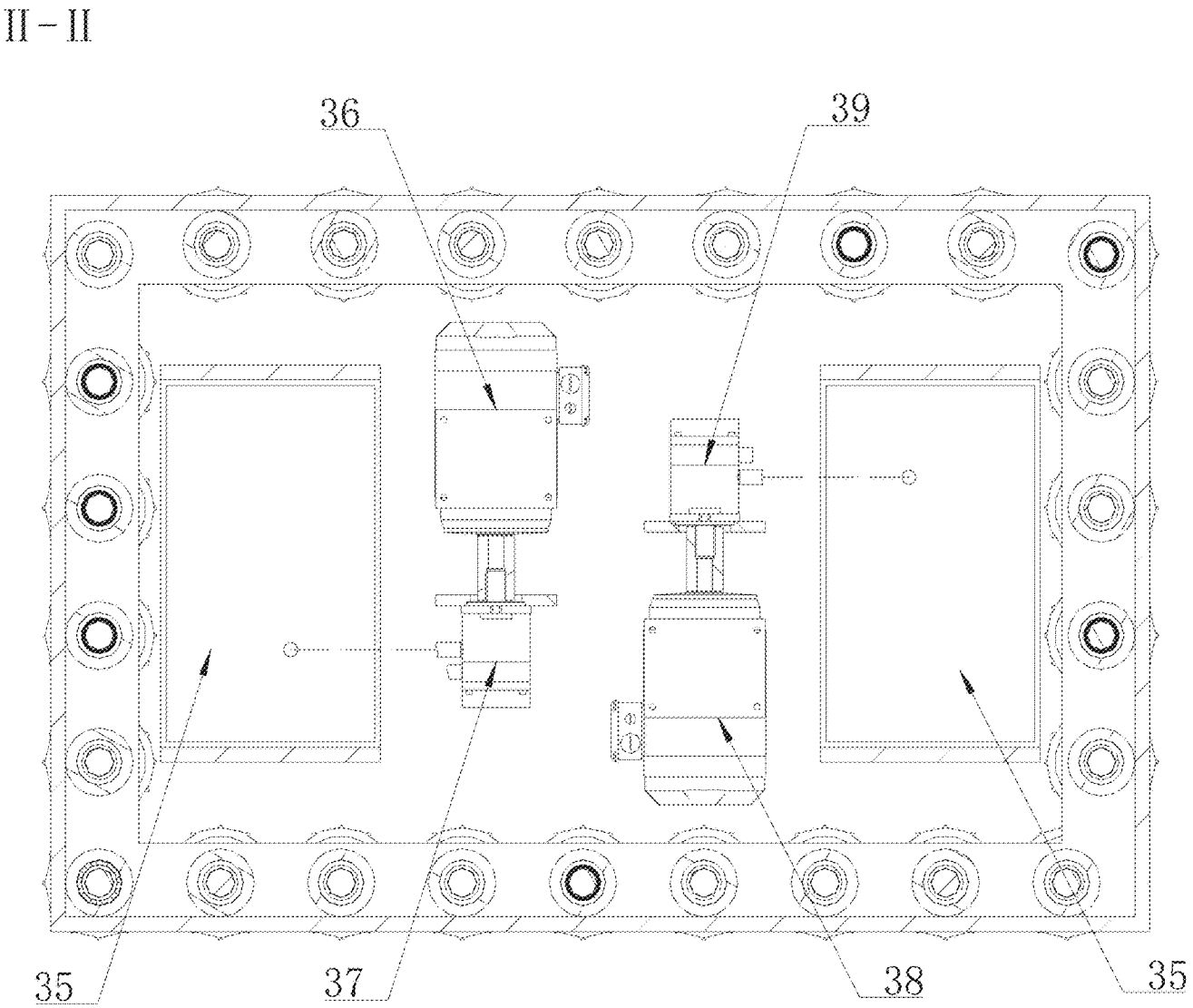
FIG. 23 is a schematic view of the sectional structure along line B-B of FIG. 21.

The outer edge of the frame 22 is uniformly installed with the third actuating components 211. As shown in FIG. 17 to FIG. 19, the third actuating component 211 comprises transmission shafts 215, shaft sleeves 216 and cutting actuating elements 212. The shaft sleeve 216 is connected to the outer edge of the frame 22 by screws, and the inside of the shaft sleeve 216 is rotatably connected with the transmission shaft 215 by the bearing. The cutting actuating element 212 comprises first cutting actuating elements 217 and second cutting actuating elements 218. The first cutting actuating element 217 and the second cutting actuating element 218 are fixedly connected to the lower ends of two adjacent transmission shafts 215 respectively, and the first cutting actuating element 217 and the second cutting actuating element 218 are distributed in a staggered manner. The cutting parts of the cutting actuating element 212 itself are distributed in a staggered manner in the up-and-down direction, as shown in FIG. 17, so as to realize cutting position abdication and cross cutting. According to one embodiment, a single first cutting actuating element 217 comprises a plurality of symmetrically arranged structures with the shape of dual parallel lines of equal length and a plurality of protrusions are arranged on the horizontal structures. Correspondingly, a single second cutting actuating element 218 comprises a plurality of symmetrically arranged structures with the shape of a line, and the number, shape and size of the structure with the shape of the line all correspond to those of the structure with the shape of dual parallel lines of equal length of the first cutting actuating element 217 so as to right snap into the middle of the two horizontal structures. Similarly, the horizontal structure of the structure with the shape of the line is also provided with several protrusions. When the first cutting actuating element 217 and the second cutting actuating element 218 are engaged with each other, the protrusions on their horizontal structures are disposed in a staggered manner. In one embodiment (the illustrated embodiment), the number of the structures with the shape of dual parallel lines of equal length on a single first cutting actuating element 217 and the number of the structures with the shape of the line on a single second cutting actuating element 218 are respectively set to be three. As shown in FIG. 12, a plurality of cutting actuating elements 212 are arranged in a rectangular shape as a whole, and the respective cutting actuating elements 212 is arranged along the inner wall of the box body in turn, without interfering with each other, and are used for cutting piles with square holes.

Figure 14:
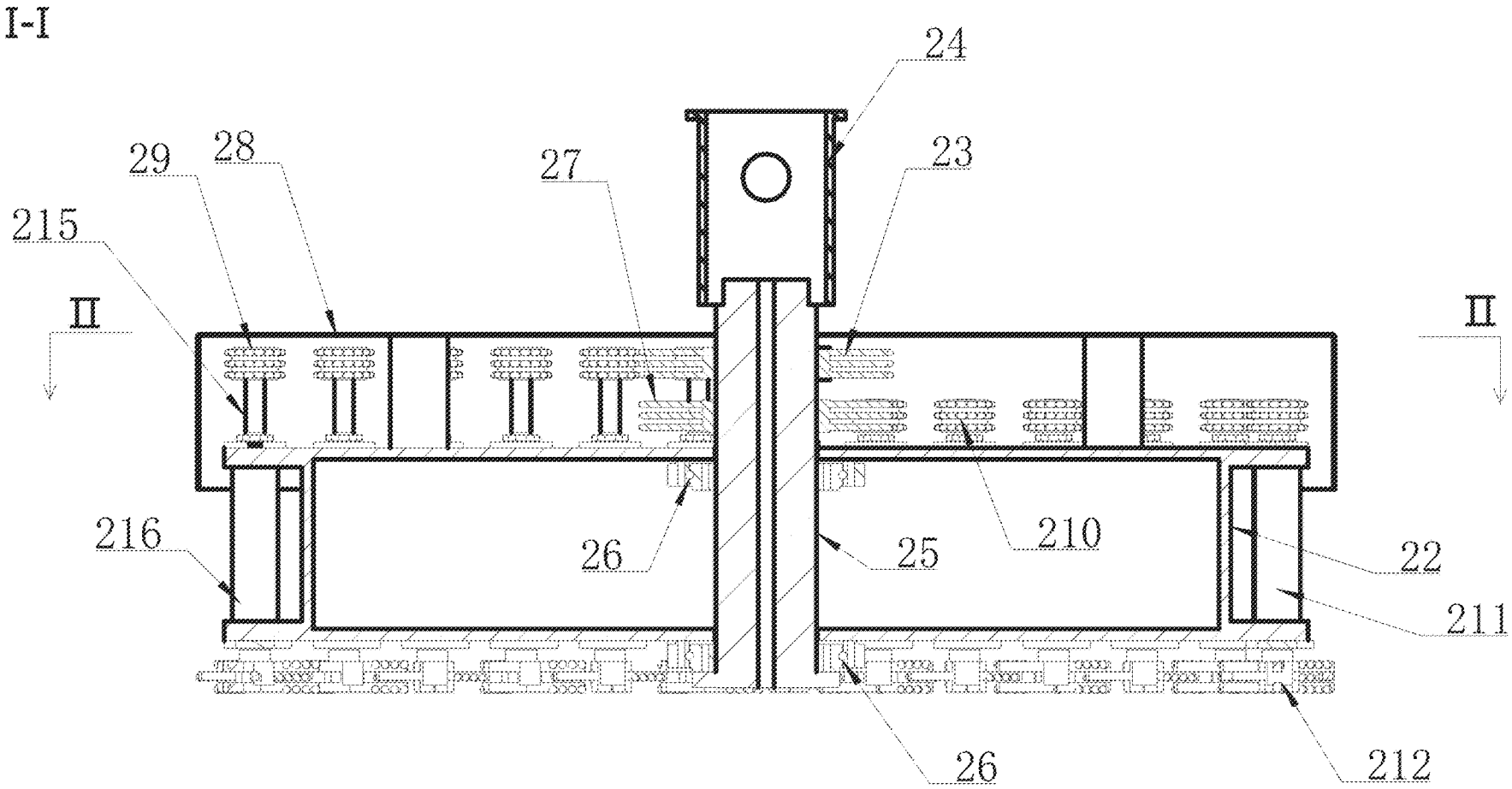
FIG. 14 is a schematic structural view along line A-A of FIG. 13.
Figure 15:
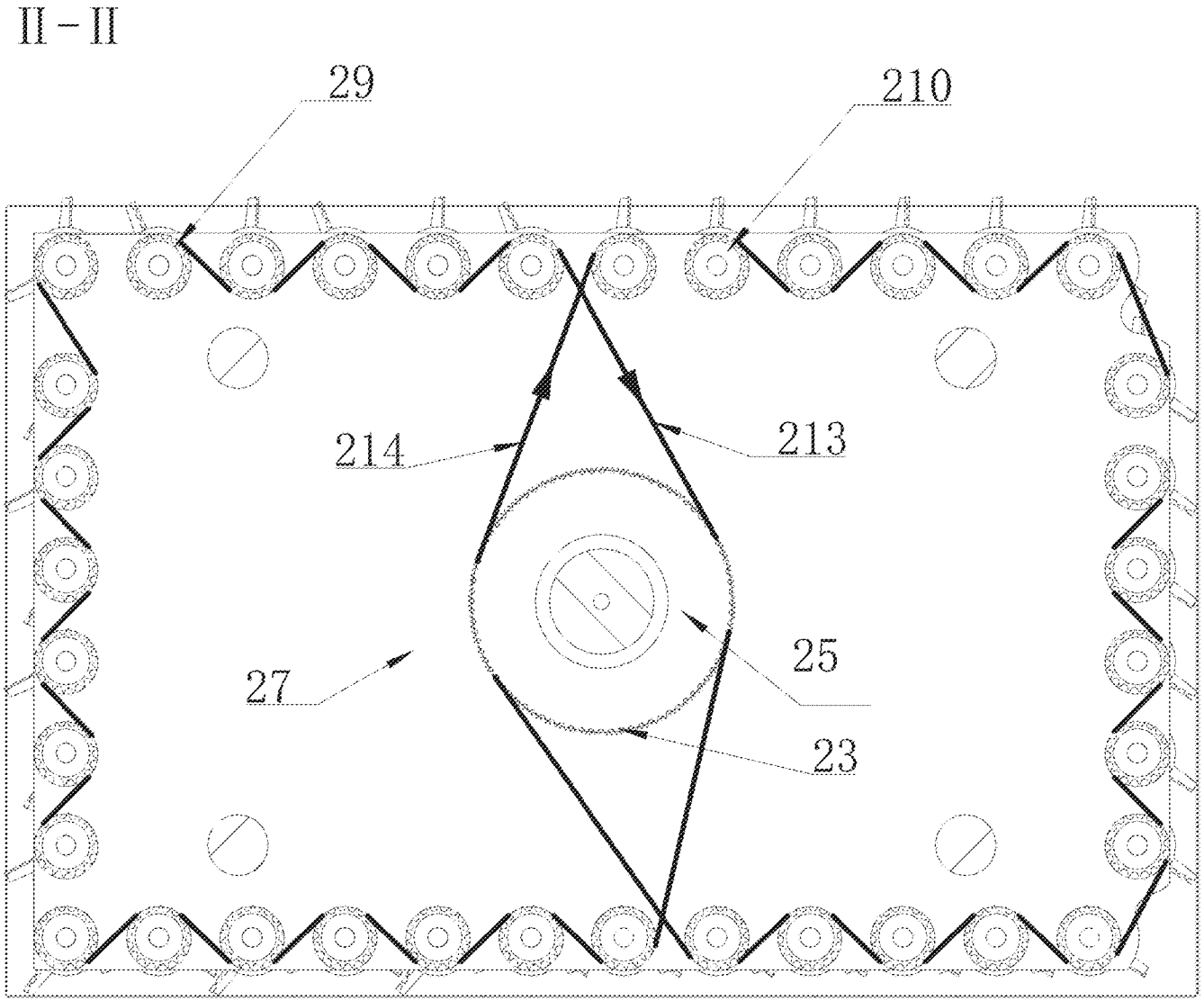
FIG. 15 is a schematic structural view along line B-B of FIG. 14.
Figure 16:
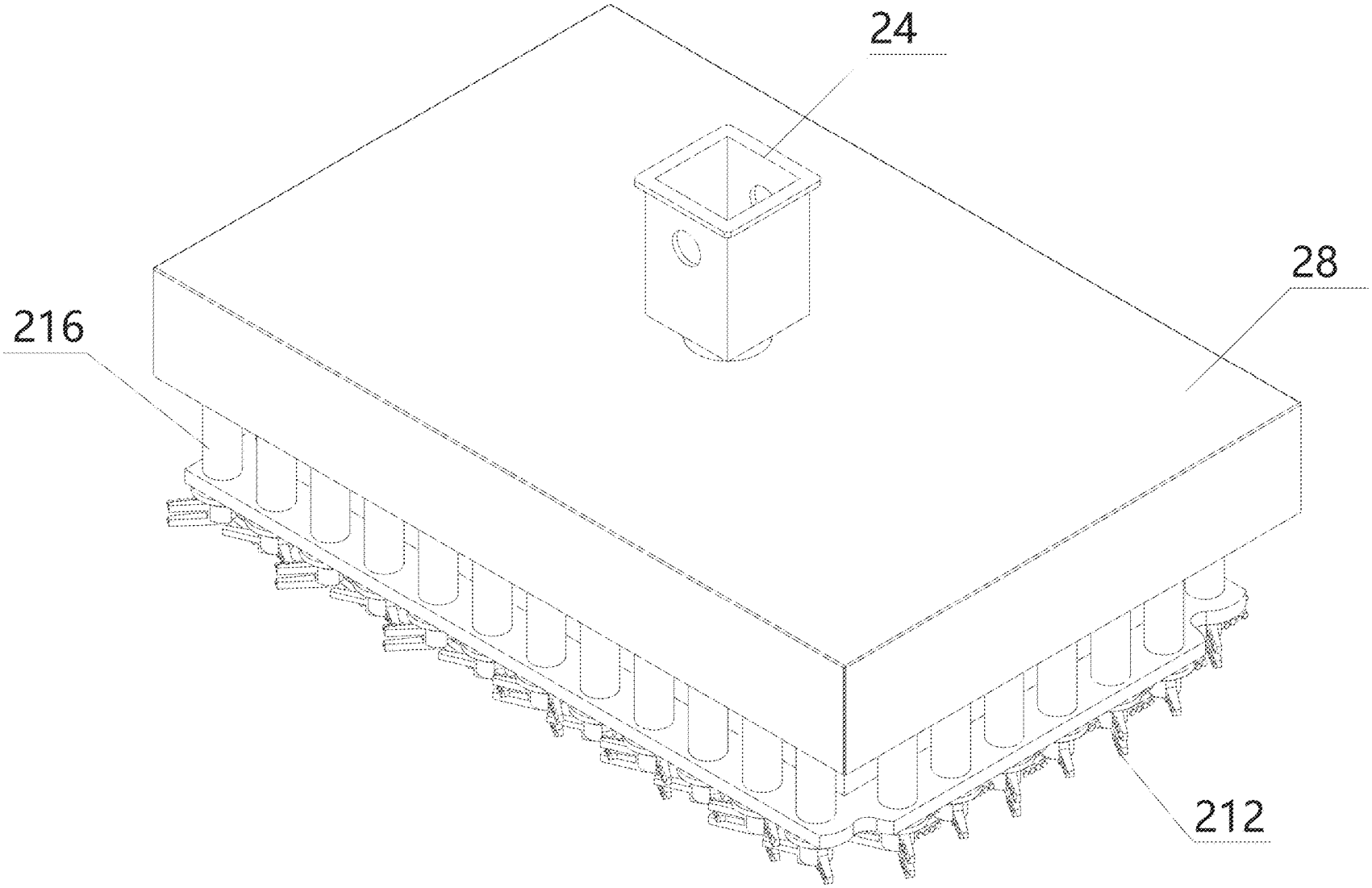
FIG. 16 is a schematic perspective view of the structure of FIG. 11.

As shown in FIG. 14 and FIG. 15, the power transmission component 27 is arranged between the third actuating component 211 and the power head component 21. The power transmission component 27 comprises driving sprockets 23, first driven sprockets 29, second driven sprockets 210, first transmission chains 213 and second transmission chains 214. The upper end of the second power transmission shaft 25 is installed with two driving sprockets 23, and the positions of the two driving sprockets 23 are in up-and-down correspondence. The upper end of the transmission shaft 215 on the left side is connected with the first driven sprocket 29 by screws, and the upper end of the transmission shaft 215 on the right side is connected with the second driven sprocket 210 by screws. The first driven sprocket 29 and the driving sprocket 23 on the upper side are in the same plane, and the second driven sprocket 210 and the driving sprocket 23 on the lower side are in the same plane. The first transmission chain 213 is installed between the driving sprocket 23 on the upper side and the first driven sprocket 29, and the second transmission chain 214 is installed between the driving sprocket 23 on the lower side and the second driven sprocket 210. The driving sprocket 23 drives the first driven sprocket 29 and the second driven sprocket 210 to rotate, and then the cutting actuating element 212 is driven to rotate for cutting (in order to prevent neatness from being compromised by too many lines, the first transmission chain 213 and the second transmission chain 214 are not schematically shown in FIG. 14).

The driving sprocket 23 is matched with both the first driven sprocket 29 and the second driven sprocket 210, and the lengths of the outer diameters of the first driven sprocket 29 and the second driven sprocket 210 are the same. The length of the outer diameter of the driving sprocket 23 is larger than those of the first driven sprocket 29 and the second driven sprocket 210. That is, the large sprocket drives the small sprocket to rotate, so as to achieve the purpose of increasing the speed by transmission.

The second power transmission shaft 25 is a stepped shaft, and the stepped part of the second power transmission shaft 25 is located at the lower side of the frame 22, so as to realize the power input and rotation of the second power transmission shaft 25, while the frame 22 is in a stationary state. Meanwhile, the stepped part of the second power transmission shaft 25 may support and protect the frame 22 when the slewing bearing 26 breaks down. The slewing bearing 26 is a slewing bearing without external teeth. The upper side of the frame 22 is connected with a protective cover 28 by screws.

The working principle of this embodiment is as follows: the rotary drilling rig inputs power through the second connecting square head 24 to drive the second power transmission shaft 25 to rotate, and the second power transmission shaft 25 simultaneously drives the upper and lower driving sprockets 23 to rotate. Because the driving sprocket 23 on the upper side is in transmission connection with the first driven sprocket 29 through the first transmission chain 213, and the driving sprocket 23 on the lower side is in transmission connection with the second driven sprocket 210 through the second transmission chain 214, the transmission shaft 215 is driven to rotate, and then the cutting actuating element 212 is driven to rotate for cutting, so that piles with square hole are drilled on the basis of the piles with round holes.

A third embodiment of the square pile drill bit is as shown in FIG. 20 to FIG. 25. A hydraulic grinding square pile drill bit comprises a box body 31, and the edges inside the box body 31 are longitudinally provided with evenly arranged grinding shaft sleeves 32. The lower ends of the evenly arranged grinding shaft sleeves 32 all penetrate the lower sidewall of the box body 31 and extend to the lower outer end of the box body 31, and are fixedly provided with grinding heads 33. The upper ends of the grinding shaft sleeves 32 all penetrate the upper sidewall of the box body 31 and extend to the upper outer end of the box body 31, and are fixedly provided with hydraulic motors 34. The sidewall of the hydraulic motor 34 is fixedly provided with an oil outlet, and the upper end of the oil outlet is fixedly provided with an oil inlet. Symmetrical oil tanks 35 are fixedly arranged inside the box body 31, and the oil outlet and the oil inlet are connected with the corresponding oil tanks 35 through pipelines respectively, so as to realize oil input and output; and specific oil input and output directions are as shown by the arrow direction in FIG. 22. A plurality of oil tanks 35 may be provided according to actual needs, and the figure shows a case where two oil tanks are provided. A first motor 36 is fixedly arranged between the two oil tanks 35, and the output end of the first motor 36 is fixedly provided with a first hydraulic pump 37. The sidewall of the first hydraulic pump 37 is fixedly provided with a first inlet and a first outlet, the right end of the first motor 36 is fixedly provided with a second motor 38, the output end of the second motor 38 is fixedly provided with a second hydraulic pump 39, and the sidewall of the second hydraulic pump 39 is fixedly provided with a second inlet and a second outlet. The oil outlet of the hydraulic motor 34 is fixedly connected with the oil tank 35, the first inlet of the first hydraulic pump 37 and the second inlet of the second hydraulic pump 39 are all fixedly connected with the oil tank 35, and the first outlet of the first hydraulic pump 37 and the second outlet of the second hydraulic pump 39 are all fixedly connected with the hydraulic motor 34.

The upper sidewall of the box body 31 is fixedly provided with an anti-rotation plate 310, and the inside of the anti-rotation plate 310 is longitudinally provided with a third connecting square head 311. The lower sidewall of the third connecting square head 311 is fixedly connected with the upper sidewall of the box body 31, the sidewall of the third connecting square head 311 is fixedly provided with symmetrical square head reinforcing plates 312, and one side of the square head reinforcing plate 312 away from the third connecting square head 311 is fixedly connected with the inner wall of the anti-rotation plate 310.

Figure 24:
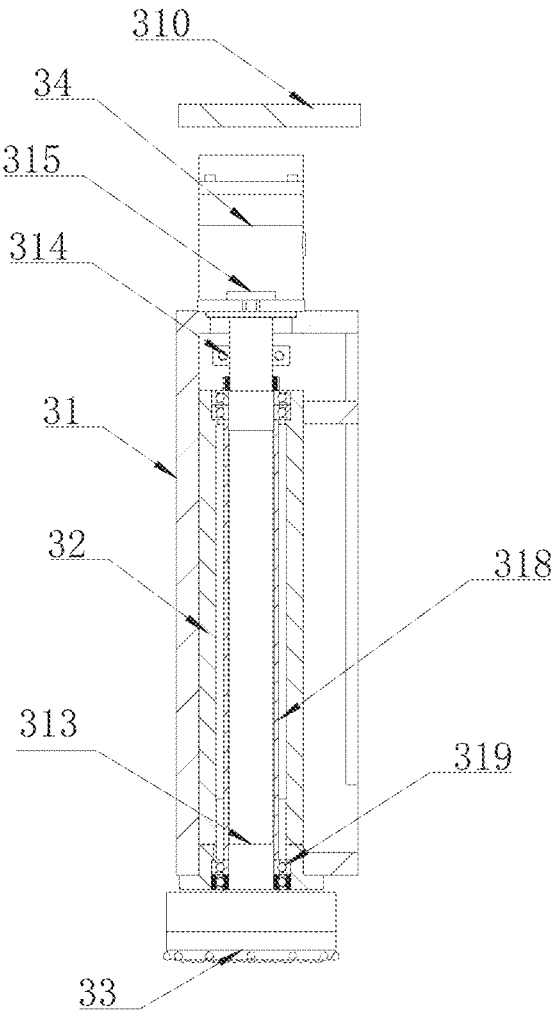
FIG. 24 is a schematic sectional view of the structure of a grinding shaft sleeve of the square pile drill bit of FIG. 20.

As shown in FIG. 24, a grinding head transmission shaft 313 is longitudinally arranged inside the grinding shaft sleeve 32, and a bearing spacer 318 is arranged between the grinding head transmission shaft 313 and the grinding shaft sleeve 32. The lower end of the grinding head transmission shaft 313 is fixedly connected with the grinding head 33 through a bearing 319.

Figure 25:
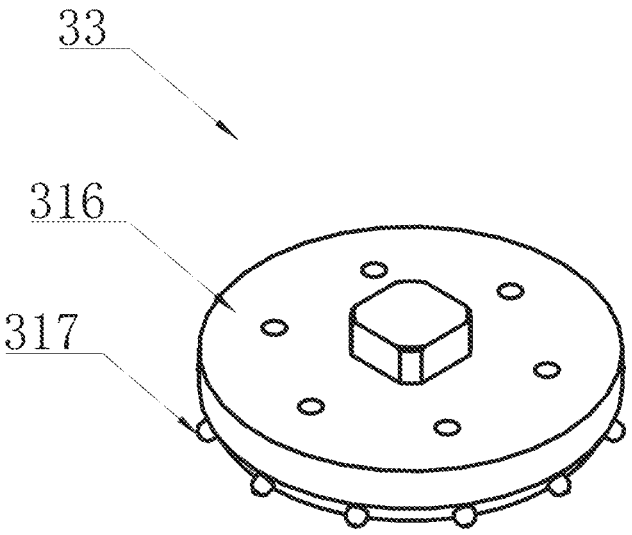
FIG. 25 is a schematic structural view of a grinding head of the square pile drill bit of FIG. 20.

The upper end of the grinding head transmission shaft 313 penetrates the upper sidewall of the grinding shaft sleeve 32 and is fixedly connected with the output end of the hydraulic motor 34. The upper end of the wall of the grinding head transmission shaft 313 is rotatably connected with the grinding shaft sleeve 32 through a lock nut 314. The lower end of the hydraulic motor 34 is fixedly provided with a clamp 315. The clamp 315 is a connecting component between the hydraulic motor 34 and the grinding head transmission shaft 313, and it is specifically a structure composed of a key and a clamp. The grinding head transmission shaft 313 is provided thereon with holes and keys, and the output shaft of the hydraulic motor 34 is correspondingly provided thereon with shafts and keys. The clamp 315 connects the two parts by locking and clamping them together, which is a mature existing technology, and the connection between the hydraulic motor 34 and the grinding head transmission shaft 313 may also be realized by other existing technologies. As shown in FIG. 25, the grinding head 33 comprises a cutter body 316 and convex components 317 made of a hard alloy material, and the convex components 317 are uniformly arranged around the cutter body 316. The square convex part at the top of the figure is a square positioning spigot provided on the part of the cutter body 316 of the grinding head 33.

The working principle of this embodiment is as follows: the third connecting square head 311 of the rotary drilling rig is directly and rigidly connected (with rigid connection) above the box body 31 of the square pile drill bit, and the square head reinforcing plate 312 is arranged between the third connecting square head 311 and the box body 31 to strengthen the connection strength thereof. In this embodiment, the power of the grinding head 33 of the square pile drill bit is driven by the hydraulic system, and the power of the hydraulic system is driven by an independent motor. When the first motor 36 and the second motor 38 are powered on to rotate, they drive the first hydraulic pump 37 and the second hydraulic pump 39 to operate. The first hydraulic pump 37 and the second hydraulic pump 39 suck hydraulic oil from the oil tank 35 through the first inlet and the second inlet respectively, and the hydraulic oil is transmitted to each hydraulic motor 34 through respective oil outlets and the oil inlets via the hydraulic system respectively through the first outlet and the second outlet, thereby driving the hydraulic motor 34 to rotate. The hydraulic motor 34 is installed on the box body 31 of the square pile drill bit, and the output shaft of the hydraulic motor 34 is connected with the transmission shaft 313 of the grinding head 33, thereby realizing the rotation of the grinding head 33. The shafts of the grinding heads 33 are regularly distributed along the four walls of the box body 31 of the square pile drill bit, and the hydraulic systems are connected in series or in parallel according to the actual working conditions, so as to realize the rotation of all the grinding heads 33 on the four walls of the box body 31 of the square pile drill bit.

A third objective of the present invention is to provide a new square drill bit for hole cleaning (mainly used in the step S10 of the above-mentioned construction method) in cooperation with the above-mentioned construction method. Specifically, as shown in FIG. 26 to FIG. 29, a rotary drilling bit for hole cleaning of square pile comprises a fourth connecting square head 41 for power input and a mounting frame plate 44. The bottom of the fourth connecting square head 41 is welded with a mounting plate, and the bottom of the mounting plate is connected with the outer ring of the slewing bearing 42 with external teeth. The inner ring of the slewing bearing 42 with external teeth is connected in the middle of the top of the mounting frame plate 44 by screws. The slewing bearing 42 is similar to a bearing structure, and the inner and outer rings thereof are respectively mounted with spigots and screw holes, and the inner and outer rings can rotate independently. The slewing bearing 42 with external teeth refers to a tooth-shaped structure with involute in its outer ring part. Here, the connection with the outer ring of the slewing bearing 42 specifically means that the mounting plate is connected with the outer ring part of the slewing bearing 42 through the positioning spigots and screws. When the fourth connecting square head 41 for power input rotates, it can drive the outer ring part of the slewing bearing 42 to rotate to transmit power, while the inner ring part of the slewing bearing 42 is connected with the mounting frame plate 44 to keep the mounting frame plate 44 stationary. Both the left and right sides of the inner top of the mounting frame plate 44 are longitudinally provided with movable grooves, and the inner wall of the movable grooves is provided with bearings, and the inner wall of the bearings is connected with the outer wall of connecting posts. The top of the connecting post extends to the outside of the mounting frame plate 44 and is connected with a transmission gear 43. The outer rings of the slewing bearing 42 with external teeth are respectively engaged with respective transmission gears 43. The bottom of the connecting posts on left and right sides are respectively connected with a first winding drum 45 and a second winding drum 46. The power is input through the fourth connecting square head 41, and it drives the slewing bearing 42 with external teeth to rotate, and the rotation is transmitted to the first winding drum 45 and the second winding drum 46 respectively through the transmission gear 43, which drives the first winding drum 45 and the second winding drum 46 to rotate.

Figure 26:
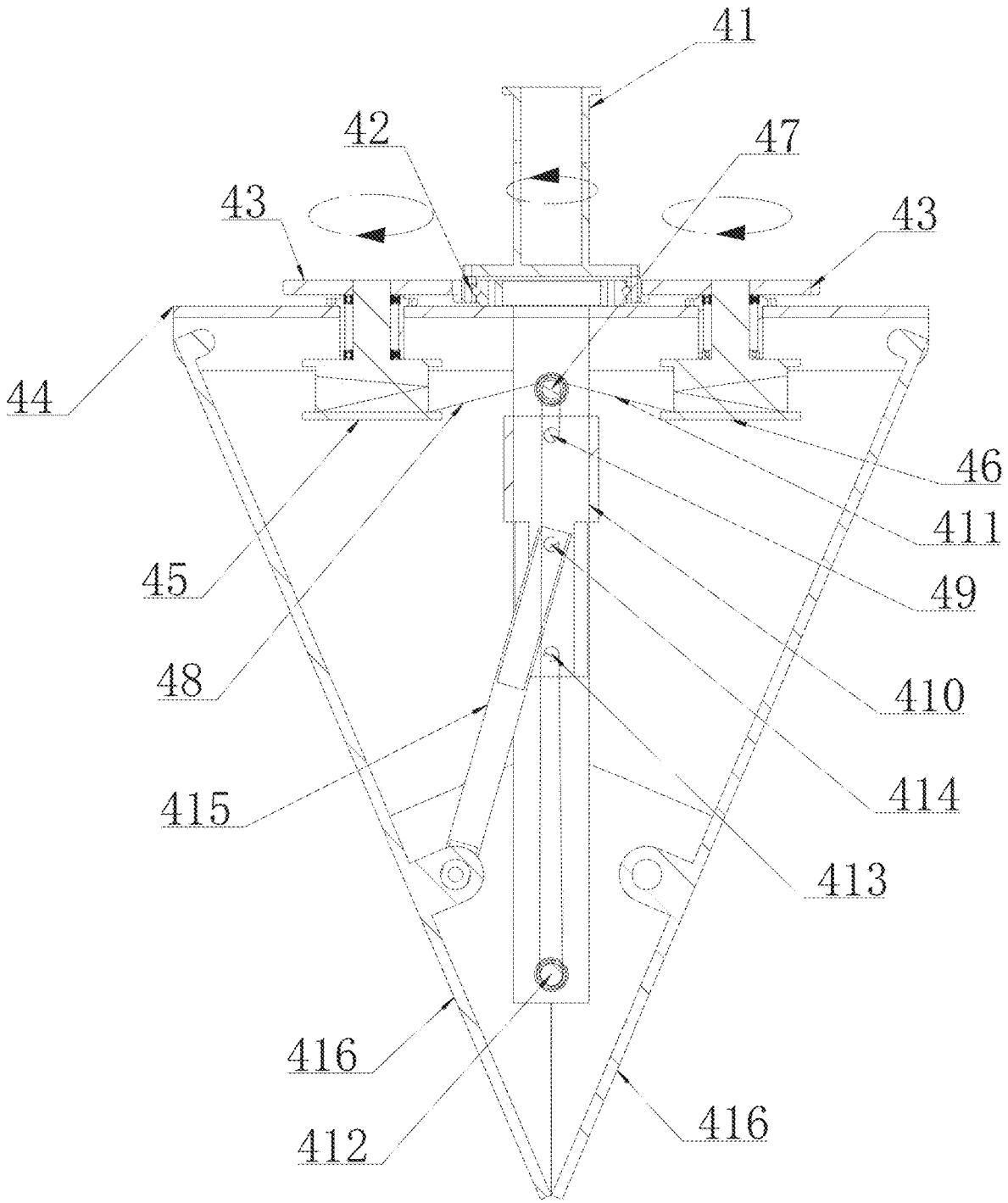
FIG. 26 is a schematic structural view of a rotary drill for hole cleaning of a square pile according to one embodiment of the present invention (in a closed state).
Figure 27:
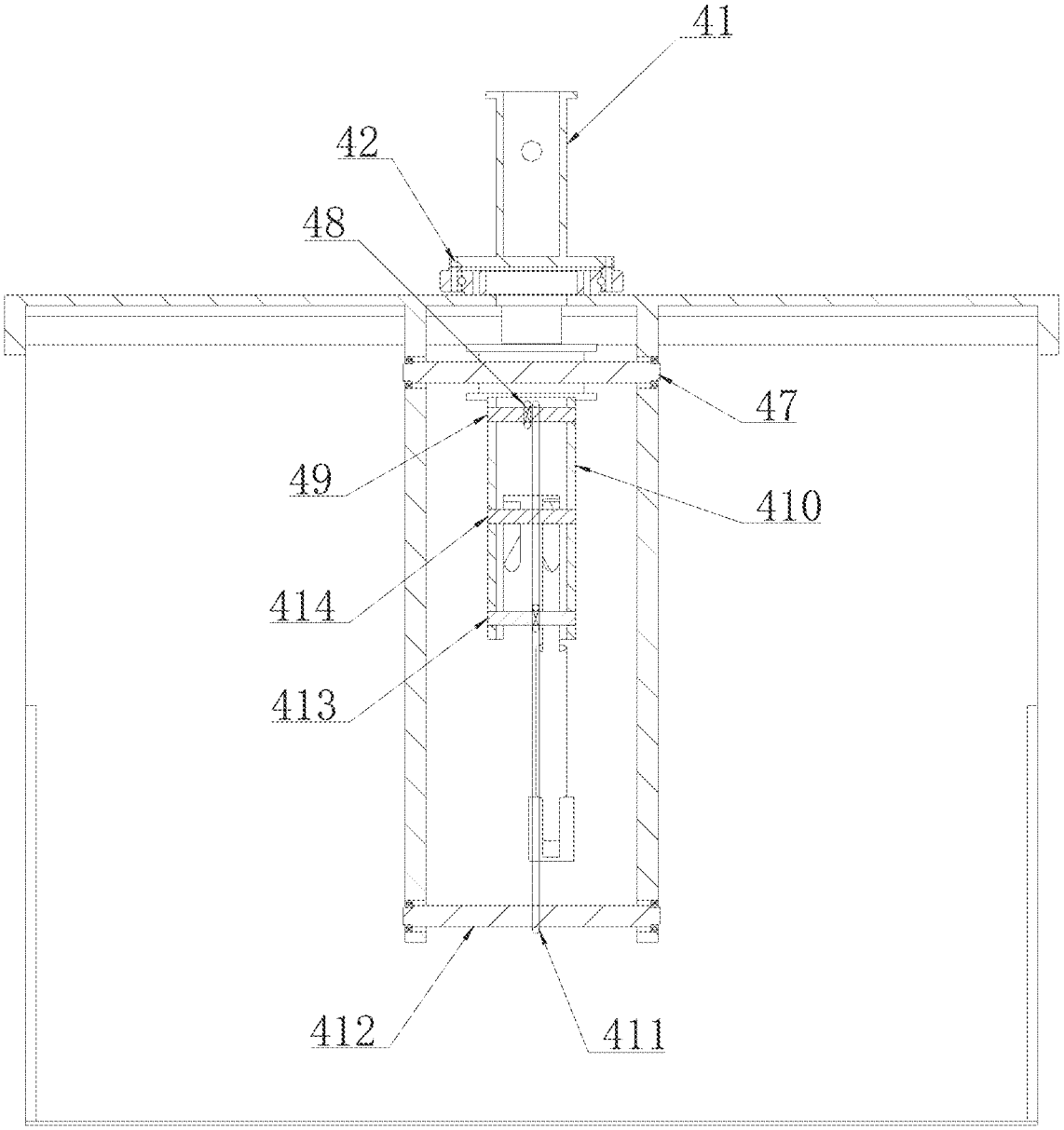
FIG. 27 is a left view of FIG. 26.
Figure 28:
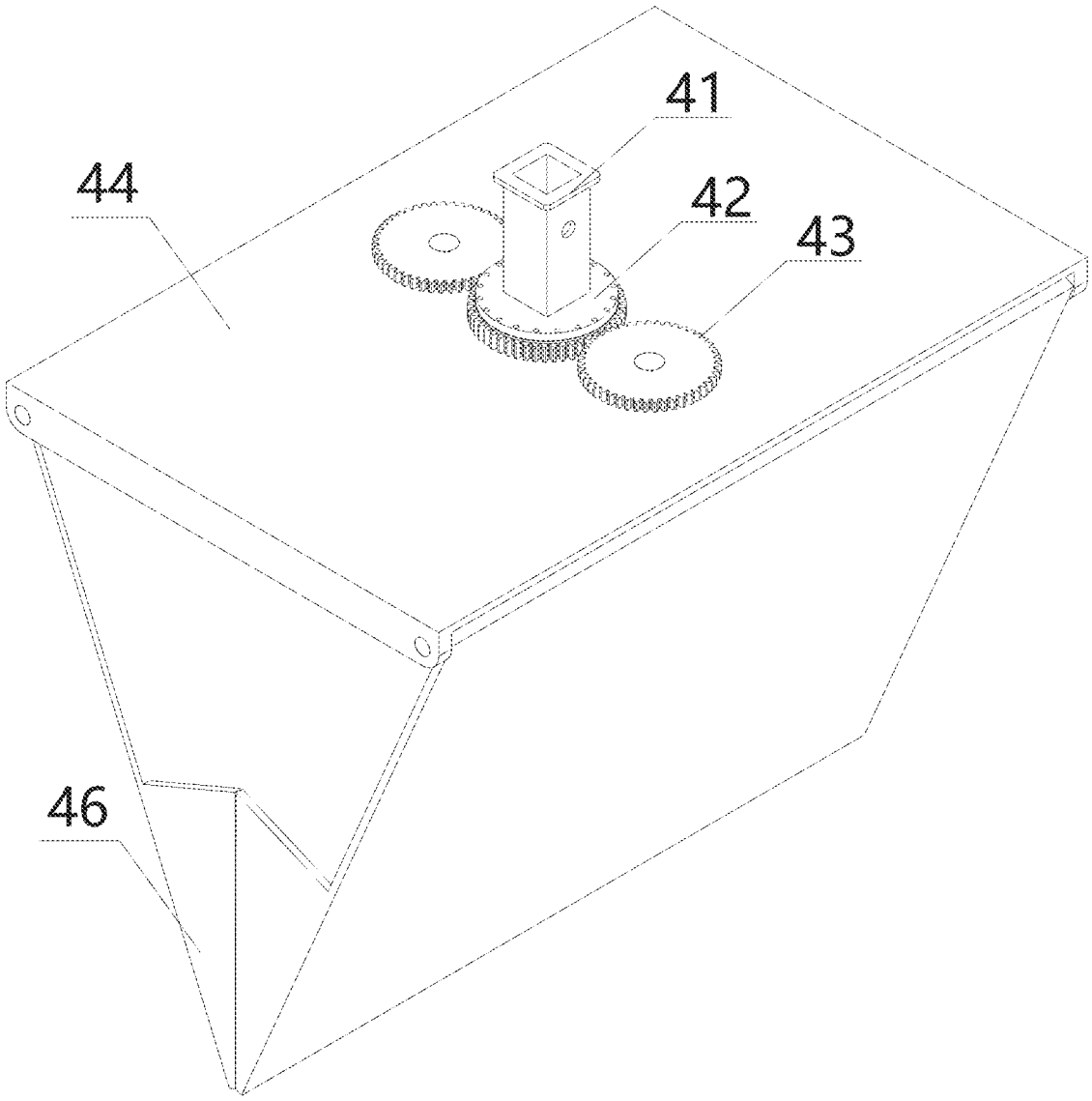
FIG. 28 is a perspective view of FIG. 26.
Figure 29:
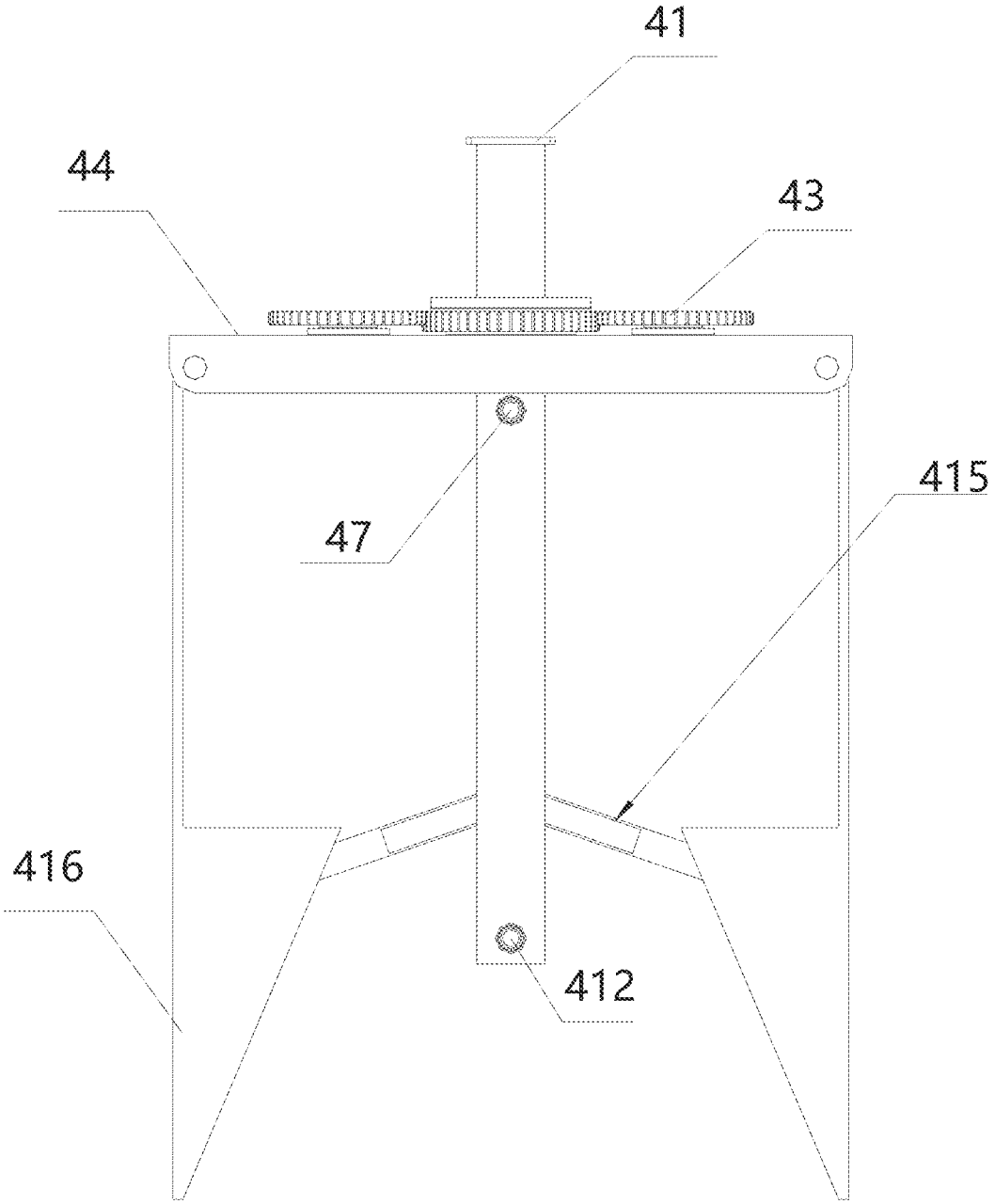
FIG. 29 is a schematic view of the unfolding structure of a soil clamping plate for the hole cleaning drill of the square pile of FIG. 26.

The middle part inside the mounting frame plate 44 is longitudinally provided with a sliding post, the top and bottom of the front face of the sliding post are respectively provided with a first connecting shaft 47 and a fifth connecting shaft 412. The outer wall of the sliding post is sleeved with a stretching connecting sleeve 410, the upper part, middle part and lower part of the front face of the stretching connecting sleeve 410 are respectively provided with a second connecting shaft 49, a third connecting shaft 414 and a fourth connecting shaft 413. The first winding drum 45 and the second winding drum 46 are respectively wound thereon with a first wire rope 48 and a second wire rope 411. The other end of the first wire rope 48 is converted and connected with a knot to the second connecting shaft 49 through the first connecting shaft 47; and the other end of the second wire rope 411 is converted and connected with a knot to the fourth connecting shaft 413 through the fifth connecting shaft 412. If one of the first wire rope 48 and the second wire rope 411 on the first winding drum 45 and the second winding drum 46 is collected on the winding drum, then the other one thereof will be released from the winding drum. The outer diameters and rotational angular velocities of the first winding drum 45 and the second winding drum 46 are completely consistent, so that the lengths of wires winded and released are equal. Both the left and right sides at the top of the mounting frame plate 44 are hinged with a soil clamping plate 416, the third connecting shaft 414 is connected with transport shafts 415 through a pin shaft, and the other end of the transport shaft 415 is hinged with the soil clamping plate 416. The transport shafts 415 are symmetrically arranged, and the number of the transport shafts 415 is equal to that of the soil clamping plates 416. When the first winding drum 45 rotates and the first wire rope 48 moves upward and shortens, the stretching connecting sleeve 410 is driven to move upward, and the angle included between respective transport shafts 415 is reduced (only one transport shaft 415 is schematically shown in FIG. 26 due to simplicity of the views), and the soil clamping plate 416 is driven to be folded in the middle for soil clamping operation. Meanwhile, the second wire rope 411 on the second winding drum 46 is released with the same length. As shown in FIG. 27, the power input fourth connecting square head 41 drives the second winding drum 46 to rotate in the opposite direction (the rotation direction is opposite to the rotation direction indicated by the arrow in FIG. 26, that is, opposite to the rotation direction during soil clamping. It shall be noted that the direction shown in the figure is only for illustration, and in practice, it can be opened by being rotated clockwise or counterclockwise according to the actual situation and the winding direction of the wires), and the second wire rope 411 thereon moves downward and shortens, and the soil clamping plate 416 tends to open downward under the action of self-gravity, and the stretching connecting sleeve 410 moves downward, so that the angle included between the two transport shafts 415 becomes larger, thus realizing the opening of the soil clamping plate 416. At the same time, the rotation of the first winding drum 45 allows the first wire rope 48 to be released with the same length.

The outer wall of the soil clamping plate 416 is provided with a wear-resistant and corrosion-resistant layer, which is a wear-resistant and corrosion-resistant coating, thus prolonging the service life and improving the wear-resistant and corrosion-resistant performance. The out wall of the slewing bearing 42 with external teeth and the outer wall of the transmission gear 43 are both provided with a lubricating layer, and the lubricating layer includes lubricating oil, thereby improving the transmission performance.

The working principle of this embodiment is as follows: the power is input through the fourth connecting square head 41, and it drives the slewing bearing 42 with external teeth to rotate, and the rotation is transmitted to the first winding drum 45 and the second winding drum 46 respectively through the transmission gear 43, which further drives the first winding drum 45 and the second winding drum 46 to rotate. The first wire rope 48 wound on the first winding drum 45 and the second wire rope 411 wound on the second winding drum 46 are wound in the forward and reverse directions respectively. The first winding drum 45 and the second winding drum 46 rotate in the same direction, and if one of the first wire rope 48 and the second wire rope 411 on the first winding drum 45 and the second winding drum 46 is collected on the winding drum, then the other one thereof will be released from the winding drum. The outer diameters and rotational angular velocities of the first winding drum 45 and the second winding drum 46 are completely consistent, so that the lengths of wires winded and released are equal. The soil clamping plates 416 are connected to the mounting frame plate 44 by a pin shaft, and the soil clamping plates 416 can rotate around their respective rotation centers. In this way, when the power input fourth connecting square head 41 rotates in the forward direction, the first winding drum 45 rotates and the first wire rope 48 moves upward and shortens, which drives the stretching connecting sleeve 410 to move upward, and the angle included between the two transport shafts 415 decreases, which drives the soil clamping plate 416 to be folded in the middle for soil clamping operation. At the same time, the second wire rope 411 on the second winding drum 46 is released with the same length. When the power input fourth connecting square head 41 rotates in the reverse direction, the second winding drum 46 rotates in the reverse direction, and the second wire rope 411 thereon moves downward and shortens, the soil clamping plate 416 tends to open downward under the action of self-gravity, and the stretching connecting sleeve 410 moves downward, so that the angle included between the two transport shafts 415 becomes larger, thus realizing the opening of the soil clamping plate 416. At the same time, the rotation of the first winding drum 45 allows the first wire rope 48 to be released with the same length.

The embodiments described above only describe the preferred mode of the present invention, and do not limit the scope of the present invention. Without departing from the design spirit of the present invention, all kinds of transformations, variations, modifications and substitutions made by those of ordinary skill in the art to the technical solution of the present invention should fall within the protection scope determined by the claims of the present invention.

What is claimed is:

1. A square pile drill bit, comprising a box body, first and second transmission shafts, first sprockets, second sprockets, and first chains, the box body including a power driving device, a power transmission mechanism and an actuator, the power driving device being connected with the power transmission mechanism, the power transmission mechanism being connected with the actuator, the box body having a lower part with left and right sides, the actuator comprising first actuating components and second actuating components, the first actuating components being at the left and right sides of the lower part of the box body, each of the first actuating components being in transmission connection with a corresponding one of the first and second transmission shafts through a corresponding one of the first sprockets, a corresponding one of the second sprockets and a corresponding one of the first chains, and the second actuating components being at ends of the first and second transmission shafts external to the box body, wherein:

each of the first actuating components comprises a rotary shaft and a first digging actuating element, the rotary shaft is rotatably connected with the box body and has (i) an outer wall fixedly connected with the first digging actuating element and (ii) front and rear ends connected with ones of the second sprockets, the first and second transmission shafts are connected with the first sprockets, the first sprockets are aligned with the second sprockets, the first chains are in contact with corresponding ones of the first and second sprockets, each of the second actuating components comprises a crawler-type driving wheel, a crawler-type driven wheel, a crawler chain rail, a second digging actuating element, a power plate and a driven shaft, the crawler-type driving wheel is connected with one end of a corresponding one of the first and second transmission shafts external to the box body, the driven shaft is rotatably connected with the left and right sides of the lower part of the box body, the driven shaft has front and rear ends connected with the crawler-type driven wheel, the crawler-type driving wheel and the crawler-type driven wheel are aligned, the crawler chain rail is between the crawler-type driving wheel and the crawler-type driven wheel, the crawler chain rail has an outer wall fixedly connected with the power plate, and the power plate has front and rear sides connected with the second digging actuating element.

2. The square pile drill bit of claim 1, wherein the power driving device is connected with the power transmission mechanism, the power transmission mechanism comprises a first driving sprocket, a second driving sprocket, power input sprockets, the first chains, reversing transmission boxes, the first and second transmission shafts, the first sprockets, the second sprockets and second chains, the square pile drill bit further comprises a power transmission shaft connected with the first driving sprocket and corresponding ones of the second driving sprockets, the first driving sprockets are above the second driving sprockets, the box body has an inner cavity with left and right sides connected with the reversing transmission boxes, each of the reversing transmission boxes has an input shaft connected with the power input sprocket, the first chains are between (i) a first one of the power input sprockets and the first driving sprocket and (ii) a second one of the power input sprockets and the second driving sprocket, each of the reversing transmission boxes includes an output shaft, and the output shaft is connected with a corresponding one of the first and second transmission shafts via a shaft coupler.

3. The square pile drill bit of claim 2, wherein the power driving device comprises the power transmission shaft, a first connecting square head, a lifting pressure plate and a pressure conducting plate, the power transmission shaft is in a center of the box body, the power transmission shaft is rotatably connected with the box body via a bearing, the bearing has upper and lower sides respectively including a first bearing pressure plate and a second bearing pressure plate, the first bearing pressure plate and the second bearing pressure plate are fixedly connected with the box body, the box body has an upper end connected with the lifting pressure plate, the power transmission shaft has an upper outer wall with a shoulder, the shoulder is in the lifting pressure plate, the shoulder includes the pressure conducting plate, the pressure conducting plate is fixedly connected to the box body, and the power transmission shaft is fixedly connected with the first connecting square head.

4. The square pile drill bit of claim 1, wherein the power driving device comprises a power transmission shaft, and the box body has a lower side.

5. The square pile drill bit of claim 4, further comprising a lifting protection shaft at the lower side of the power transmission shaft, and connected with the lower side of the box body.

6. A square pile drill bit, comprising:

a box body, first and second transmission shafts, first sprockets and second sprockets, first chains, and a power transmission shaft, wherein:

the box body includes a power driving device, a power transmission mechanism and an actuator, the power driving device is connected with the power transmission mechanism, the power transmission mechanism is connected with the actuator, the box body has a lower part with left and right sides, the actuator comprises first actuating components and second actuating components, the first actuating components are at the left and right sides of the lower part of the box body, each of the first actuating components is in transmission connection with a corresponding one of the first and second transmission shafts through a corresponding one of the first sprockets, a corresponding one of the second sprockets and a corresponding one of the first chains, the second actuating components are at ends of the first and second transmission shafts external to the box body, the power transmission mechanism comprises a first driving sprocket, a second driving sprocket, power input sprockets, the first chains, reversing transmission boxes, the first and second transmission shafts, the first sprockets, the second sprockets and second chains, the power transmission shaft is connected with the first driving sprocket and corresponding ones of the second driving sprockets, the first driving sprockets are above the second driving sprockets, the box body has an inner cavity with left and right sides connected with the reversing transmission box, the reversing transmission box has an input shaft connected with the power input sprocket, the first chains are between (i) a first one of the power input sprockets and the first driving sprocket and (ii) a second one of the power input sprockets and the second driving sprocket, the reversing transmission box includes an output shaft, and the output shaft is connected with a corresponding one of the first and second transmission shafts via a shaft coupler.

7. The square pile drill bit of claim 6, wherein each of the first actuating components comprises a rotary shaft and a first digging actuating element, the rotary shaft is rotatably connected with the box body and has (i) an outer wall fixedly connected with the first digging actuating element and (ii) front and rear ends connected with ones of the second sprockets, the first and second transmission shafts are connected with the first sprockets, the first sprockets are aligned with the second sprockets, and the first chains are in contact with corresponding ones of the first and second sprockets.

8. The square pile drill bit of claim 6, wherein each of the second actuating components comprises a crawler-type driving wheel, a crawler-type driven wheel, a crawler chain rail, a second digging actuating element, a power plate and a driven shaft, the crawler-type driving wheel is connected with one end of a corresponding one of the first and second transmission shafts external to the box body, the driven shaft is rotatably connected with the left and right sides of the lower part of the box body, the driven shaft has front and rear ends connected with the crawler-type driven wheel, the crawler-type driving wheel and the crawler-type driven wheel are aligned, the crawler chain rail is between the crawler-type driving wheel and the crawler-type driven wheel, the crawler chain rail has an outer wall fixedly connected with the power plate, and the power plate has front and rear sides connected with the second digging actuating element.

9. The square pile drill bit of claim 6, wherein the power driving device comprises the power transmission shaft, a first connecting square head, a lifting pressure plate and a pressure conducting plate.

10. The square pile drill bit of claim 9, wherein the power transmission shaft is in a center of the box body and is rotatably connected with the box body via a bearing.

11. The square pile drill bit of claim 9, wherein the bearing has upper and lower sides respectively including a first bearing pressure plate and a second bearing pressure plate.

12. The square pile drill bit of claim 11, wherein the first bearing pressure plate and the second bearing pressure plate are fixedly connected with the box body.

13. The square pile drill bit of claim 9, wherein the box body has an upper end connected with the lifting pressure plate.

14. The square pile drill bit of claim 9, wherein the power transmission shaft has an upper outer wall with a shoulder.

15. The square pile drill bit of claim 14, wherein the shoulder is in the lifting pressure plate.

16. The square pile drill bit of claim 14, wherein the shoulder includes the pressure conducting plate.

17. The square pile drill bit of claim 9, wherein the pressure conducting plate is fixedly connected to the box body.

18. The square pile drill bit of claim 9, wherein the power transmission shaft is fixedly connected with the power input first connecting square head.

19. The square pile drill bit of claim 6, further comprising a lifting protection shaft at a lower side of the power transmission shaft, wherein the lifting protection shaft is connected with a lower side of the box body.

* * * * *